US011396202B2

(12) United States Patent
Husmann

(10) Patent No.: US 11,396,202 B2
(45) Date of Patent: Jul. 26, 2022

(54) PRODUCT MARKETING MAGAZINE RIDER

(71) Applicant: Mark Husmann, Las Vegas, NV (US)

(72) Inventor: Mark Husmann, Las Vegas, NV (US)

( * ) Notice: Subject to any disclaimer, the term of this patent is extended or adjusted under 35 U.S.C. 154(b) by 0 days.

(21) Appl. No.: 16/925,877

(22) Filed: Jul. 10, 2020

(65) Prior Publication Data

US 2020/0338921 A1 Oct. 29, 2020

Related U.S. Application Data

(63) Continuation of application No. 15/166,251, filed on May 26, 2016, now abandoned, which is a continuation-in-part of application No. 14/984,970, filed on Dec. 30, 2015, now abandoned, which is a continuation of application No. 14/121,459, filed on Sep. 9, 2014, which is a continuation of application No. 13/998,372, filed on Oct. 24, 2013, now Pat. No. 8,851,279.

(60) Provisional application No. 62/230,564, filed on Jun. 9, 2015, provisional application No. 62/230,151, filed on May 29, 2015, provisional application No. 62/230,150, filed on May 28, 2015.

(51) Int. Cl.

| | |
|---|---|
| ***B42D 3/18*** | (2006.01) |
| ***B65D 77/04*** | (2006.01) |
| ***B42D 3/12*** | (2006.01) |
| ***G09F 23/10*** | (2006.01) |
| ***G09F 1/00*** | (2006.01) |

(52) U.S. Cl.

CPC ..... *B42D 3/18* (2013.01); *B42D 3/12* (2013.01); *B65D 77/042* (2013.01); *G09F 1/00* (2013.01); *G09F 23/10* (2013.01); *B65D 2221/00* (2013.01)

(58) Field of Classification Search

CPC ..... B42D 3/18; B42D 3/12; B65D 77/042; B65D 2221/00; G09F 1/00; G09F 23/10

See application file for complete search history.

(56) References Cited

U.S. PATENT DOCUMENTS

| | | | | | |
|---|---|---|---|---|---|
| 1,145,848 | A | * | 7/1915 | Robins | F21V 33/0048 362/99 |
| 1,848,980 | A | * | 3/1932 | Walker | B43K 23/001 281/15.1 |
| 2,728,450 | A | * | 12/1955 | Haire | B65D 75/06 206/459.5 |
| 2,906,267 | A | | 9/1959 | Loudon | |
| 3,253,770 | A | | 5/1966 | Black | |

(Continued)

*Primary Examiner* — Jacob K Ackun

(74) *Attorney, Agent, or Firm* — Pillsbury Winthrop Shaw Pittman LLP

(57) ABSTRACT

A publication and product delivery package is disclosed which permits a variety of products to be packaged and displayed along the binding (or "spine") of a publication, such as a magazine, or an object of similar size, or in other places alongside such a publication, and delivered to a purchaser of that publication in an attractive, efficient, cost effective way, utilizing standard delivery services such as the United States Postal Service. The publication package allows delivery of products which are otherwise loose, liquid, or fragile to arrive intact, despite the stresses and impacts of such packaging, display, and delivery. The publication package also allows additional high-impact and memorable marketing text and images, which providing exposure of product names and graphics, and coordinated text and images.

13 Claims, 19 Drawing Sheets

(56) References Cited

U.S. PATENT DOCUMENTS 4,090,608 A 5/1978 McCall
4,114,757 A 9/1978 Sieffert
RE30,163 E 12/1979 Meyer
4,369,882 A * 1/1983 Schluger ..... B65D 75/28 206/216
4,492,306 A * 1/1985 Cooper ..... G09F 23/10 206/216
4,925,029 A * 5/1990 Friedman ..... A45D 34/00 206/459.5
4,989,728 A * 2/1991 Neyret ..... B65D 85/109 206/248
5,064,114 A 11/1991 Cravens
5,106,013 A 4/1992 Southwell
5,209,349 A 5/1993 Porter
5,251,759 A * 10/1993 Gannon ..... B65D 75/002 206/232
5,368,333 A 11/1994 Arroyo
5,397,156 A * 3/1995 Schach ..... B41F 17/02 206/424
5,716,075 A * 2/1998 Evert, Jr. ..... B42D 3/00 206/232
5,845,781 A 12/1998 Alico
5,984,560 A 11/1999 Bedol
6,079,748 A * 6/2000 Kaufman ..... B42D 1/007 281/22
6,092,663 A * 7/2000 Dixon ..... B65D 5/5016 206/472
6,132,127 A 10/2000 Bedol
6,132,216 A 10/2000 Muntean
6,220,440 B1 * 4/2001 Singerman ..... B65D 71/00 206/232
6,247,729 B1 * 6/2001 Kaufman ..... B42D 1/007 281/22
6,308,988 B1 10/2001 Mylander
6,685,226 B2 * 2/2004 McKinney ..... B42D 1/007 206/232
6,974,158 B1 * 12/2005 Westcott, Jr. ..... B42D 3/12 281/29
7,360,960 B2 * 4/2008 Hite ..... B42D 5/003 281/30
8,851,279 B1 * 10/2014 Husmann ..... B65D 65/02 206/232
2001/0000480 A1 * 4/2001 Stagg ..... B65D 33/16 428/43
2005/0146131 A1 7/2005 Ward
2005/0230954 A1 10/2005 Carrington
2006/0038395 A1 2/2006 Anderson-Thompson
2006/0261591 A1 11/2006 Hewitt
2007/0102918 A1 * 5/2007 Kaufman ..... A63H 33/38 281/15.1
2007/0187290 A1 8/2007 Zimmerman
2015/0115590 A1 * 4/2015 Husmann ..... B42D 3/00 281/21.1
2016/0114611 A1 * 4/2016 Husmann ..... B65D 65/02 281/21.1
2016/0271993 A1 * 9/2016 Husmann ..... G09F 1/00
2016/0271994 A1 * 9/2016 Husmann ..... B42D 3/12
2017/0021657 A1 * 1/2017 Husmann ..... B65D 85/70
2019/0255872 A1 * 8/2019 Husmann ..... B65D 65/02
2020/0338921 A1 * 10/2020 Husmann ..... G09F 1/00

* cited by examiner

PRODUCT MARKETING MAGAZINE RIDER

CROSS-REFERENCE AND RELATED APPLICATIONS

This application is a Continuation of U.S. Ser. No. 15/166,251, filed on May 26, 2016, which is a Continuation-In-Part of U.S. Ser. No. 14/984,970, filed Dec. 30, 2015, which claims the benefit of U.S. Provisional Application No. 62/230,150, filed May 28, 2015, and U.S. Provisional Application No. 62/230,151, filed May 29, 2015, and U.S. Provisional Application No. 62/230,564, filed Jun. 9, 2015, and this application is also a Continuation of U.S. Ser. No. 14/121,459, filed Sep. 9, 2014, which is a Continuation of U.S. application Ser. No. 13/998,372, filed Oct. 24, 2013, now U.S. Pat. No. 8,851,279. The subject matter of each is incorporated herein by reference in entirety.

TECHNICAL FIELD OF THE INVENTION

The present invention relates generally to a device and method for the packaging and distribution of products. More specifically, the present invention relates to a device and method which permits a variety of products to be packaged for distribution and displayed while in distribution with a publication, such as a magazine, or an object of similar size. One or multiple products may then be delivered to the purchaser of that publication in an attractive, efficient, cost effective way, utilizing standard delivery services such as the United States Postal Service. The device and method of the present invention allows products which are otherwise loose, liquid, or fragile to survive in their original form, and arrive at the location of the purchaser intact, despite the stresses and impacts of such packaging, display, and delivery.

The device and method of the present invention also allows the product manufacturer or distributor to include other additional attractive marketing text and images alongside product containers, in the same "publication package." These additional text and images achieve a number of purposes, including providing additional exposures of product names, and attractive, marketing graphics. All additional text and images may be coordinated with similar text, images, colors, and overall look and feel of text and images impressed on the delivered products, or on containers which hold the delivered products, all to achieve high-impact and memorable promotion of the products so delivered, with minimal additional delivery costs over those costs of delivering the publication alone.

Product manufacturers devote considerable time and resources to advertising and promoting their products and, more particularly, to giving away sample trial portions of their products to consumers. Consumers may, with such sample trial portions, examine and even use small amounts of such products, and thereby come to an informed decision about the value and desirability of such products. It is, however, difficult to place even sample trial portions of products into the hands of the desired target market along with marketing materials which explain product use and desirability. Direct mail advertising has proven to be an effective means of product promotion, however direct mail advertising is way too costly for most products, even when only samples are used, and direct mail is often perceived as "junk mail." When products are received along with a copy of a prestigious magazine, perhaps as part of a subscription ordered by a consumer, on the other hand, the association between product and magazine is perceived as an endorsement of the product, and so increases its value to the advertiser, the publisher, and the manufacturer.

Incorporating a product sample into a magazine is a common practice, undertaken by product manufacturers in an effort to join product samples and product advertising. In such cases, the magazine is used as a "vehicle" for delivery of the product of the manufacturer. Product manufacturers and advertisers may also more effectively reach a desired group of potential customers by directing their sample products to select magazine subscribers. In such vehicle magazine product delivery, an advertisement is usually placed within a chosen magazine, accompanied by a usually flat sample of a product such as, for example, a fragrance (this is typically referred to as a "scratch and sniff" advertisement). However, due to the limitations of the design of a magazine, it is generally impractical to include samples having significant three-dimensional, fragile, or hardened shapes (such as a small glass shampoo bottle), as such shapes may prevent the vehicle magazine from fully closing, or prevent it from bending, and such three dimensional or hardened shapes are subjected to considerable stress and impact moving through the channels of the standard delivery service.

The present invention is designed to provide a means for distributing sample materials and promotional items efficiently and selectively, therefore providing a more efficient utilization of limited marketing resources, while at the same time protecting such promotional items from breakage. The present invention discloses a product sample holder which is lightweight, inexpensive, and efficient, which is designed to be utilized in conjunction with magazines or publications as a "rider," or a "ride-along" as defined by the United States Postal Service. That is, the durable holder device of the present invention is included in the same publication package with a selected magazine publication, however the holder device has additional components which stabilize it within the publication package, so that it, generally maintains its position, consistent with Postal Service regulations. One such portion is along one edge of the magazine.

Magazines which are chosen as vehicle publications for delivery using the holder device of the present invention may therefore have a wide variety of forms, from a generally square, glued binding, or tapered and stapled bindings, or no binding at all. The only shape requirement for the holder device of the present invention is that the vehicle publication have the attributes of a standard publication (typically a magazine), such as a sufficient number of pages to give the publication sufficient rigidity that it will not collapse within the outer cover of the publication package. The design of the holder device of the present invention permits easy insertion of product samples into an outer package container, secure closure of the outer package container by appropriate means, positioning of the outer package container, with backing, close to an issue of the selected magazine, and containment of all components within the product package (i.e., with magazine, outer package container with inner package containers, and backing) by "poly-bagging," or "shrink wrap," or other outer cover means. Once the product package has been sealed within an outer cover, the holder device of the present invention is consistent with standard publication delivery methods, such as direct mail, newsstand distribution, and United States Postal Service delivery, and the holder device of the present invention, along with Applicant's other similar inventions, embodies the only methodology for delivery of sample products with magazines which has been tested and approved by the United States Postal Services for such delivery. Product manufacturers may thereby reach their targeted consumers, who will receive their publication with product samples intact. Moreover, the apparatus and methodology of the present invention will not damage postal machinery, or contaminate postal customer mail boxes, carrier bags, and the like, with content leakage. As a result, fluids such as fragrances, which are flammable, and loose substances such as glitter, and other difficult-to-transport materials may be transported, even if they would be considered flammable or hazardous in other containers.

Further, the clear plastic tubing and window tubing, of some of the preferred embodiments of the outer package container of the present invention allows consumers to easily identify the samples enclosed therein (generally within inner package containers), while the backing to which the outer package container is affixed in some preferred embodiments bears additional marketing text and graphics which are coordinated with the graphics of the inner package containers. With this arrangement of inner package containers within outer package containers, and with this arrangement of attractive marketing materials on the front and the back of outer package container backings, the product manufacturer achieves a maximum of advertising space with the publication package of the present invention. All of this advertising space is viewable when in transit from the back of the publication (on the back of the backing when the backing is behind the publication), and on the front and the back of the backing when the outer package container is separated (with its backing) from the chosen magazine. All of the advertising appearing on the front and back of the backing may also be coordinated with the advertising on the outer package containers, the inner product package containers, and the products themselves, thereby insuring overall aesthetic appeal of the selected publication, and maximum advertising impact for product manufacturers when a purchaser detaches the outer package containers and backing from the selected magazine, and removes product samples for inspection and use.

DISCLOSURE OF INVENTION

Summary of the Invention

Beginning with the main components of the present invention, the holder device of a first important embodiment of the publication package of the present invention consists one or more outer package containers, a backing affixed to the outer package container, and means for securing the outer package container and backing together with a selected publication during transit. The outer package containers in this embodiment is formed preferably from clear or translucent plastic, so that potential consumers wishing to purchase the selected magazine, or one of the products contained within the outer package containers, may view its contents. The outer package containers may be circular in cross section, or generally rectangular (or generally square) or any other cross-sectional shape, so long as the containers as a whole form tubes, within which one or more inner containers may reside. The material of the outer package containers should be resilient enough, and durable enough, to withstand some rough treatment when the selected publication is injected into the hands of standard delivery services, such as the United States Postal Service. As it is within the method of the present invention to utilize such standard delivery services, it is desirable that such services test devices for delivering samples such as the present invention, and the present invention has so been tested, and approved by the United States Postal Service.

The outer package containers in this first embodiment are also preferably about as long, when placed end to end, as the selected publication is long. Approximately matching the length of the selected publication and the outer package containers is desirable because movement of the outer package containers in relation to the selected publication is thereby reduced once the outer package containers and the selected publication are "bundled" together within shrink wrap plastic or other means for holding the outer package container to the selected publication. However, it is the backing of the present invention, attached to the outer package containers which generally stabilizes the outer package containers within the publication package (explained more fully below), so the outer package containers may vary in length and number in this first important embodiment of the present invention. The outer package containers in this embodiment are also generally uniform in width along their length, and generally rectangular in cross section, creating thereby a generally uniform tube, into which products, or inner package containers, or product containers may be inserted. The outer package containers are generally closed at one of their ends during manufacture, thereby creating a closed-end tube of durable plastic. However, the outer package containers are left open at each end in some embodiments, and closed by suitable closure means at each end after filling. During manufacture, the outer package containers are left open at one of their ends (defined herein as the "top" end), so that inner package containers containing products, or product containers themselves, may be placed within the outer package containers.

The outer package containers are also preferably about as thick, when measured perpendicularly to the plane of the magazine, as the selected publication is thick. However, the outer package containers may vary in their thickness from the magazine thickness by a variance of up to one quarter inch, and still remain within U.S. Postal Service regulations. When the outer package containers and the selected publication are matched for thickness in this way, the transit through standard delivery services is easier, because the publication package is more uniform in thickness, thereby allowing faster and more uniform handling by the automated equipment of the standard delivery service, and more uniform stacking of publication packages as copies of the selected publication are stored before delivery or sale. Matching the thickness of the outer package containers and the publication also provides enhanced durability when the product package is under pressure, because the pages of the magazine in the same package are not easily compressed, and they will therefore bear considerable weight when positioned adjacent outer package containers in transit. However, the outer package containers and the selected publication need not be precisely matched in thickness in this way, as the automated handling equipment of standard delivery services and the stacking of copies of the selected publication may each accommodate some small variation in thickness between the outer package containers and the selected publication. The outer package containers of the publication package may therefore accommodate samples and sample containers of a variety of widths, as the inner package containers are inserted into the tubes of the outer package containers.

The outer package containers are also supplied with outer package closures, or formed with closures, which may be fitted over the remaining open end of the outer package containers after the inner package containers containing the products are inserted into the outer package containers. A simple means for closure is a plug, which may be fitted within the end of the outer package containers, or a cap which may be fitted over the end of the outer package containers. In the latter case, some small reduction in outside dimension of the outer package containers is desirable to maintain the uniform exterior of the outer package containers once inner package containers have been inserted into outer package containers, and their open ends closed with such a cap.

During manufacture, the outer package containers have affixed to them the outer package container "backing." The outer package container backing is formed to fit snugly against the outer package containers, and generally along their entire length, once the outer package containers are affixed to the backing.

The outer package container backing may be formed about as long as the length of the selected publication, and may be about as wide as the width of the selected publication, including the binding of the selected publication if any. With length and width about the same as the selected publication, the backing may fit against the back of the selected publication in transit (the preferred position generally), or against the front of the selected publication in transit (a potentially good position in some cases). With length and width about the same as the selected publication, the backing will tend to stay in position against the back of the selected publication in transit, so long as the covering means of the publication package of the present invention (more fully explained below) has been put in place, so that the covering means encloses the outer package containers and the selected publication. However, in some applications the backing may be considerably smaller than the publication, both in length and in width, and such variations in backing size are within the scope of the present invention.

The backing of the outer package containers is also rigid enough to resist folding within the covering means of the publication package of the present invention. Accordingly, once the covering means has been positioned around the selected publication and outer package containers (with their backing), the outer package containers will tend to remain in their intended positions, along one edge of the selected publication, or in a selected position on the front or back side of the publication, during transit by standard delivery services. Of course, the rigidity of the material from which the backing is made will determine what thickness is required to achieve this result, materials such as card stock and poster board being a bit thicker overall than materials such as rigid plastic, or even metal. Since the backing is intended also to bear advertising, the backing materials should be of a kind which accepts printing consistent with the exterior appearance of the inner package containers. The preferred embodiment of the present invention envisions lightweight cardstock, however all materials from which the backing may be made are within the scope of the present invention.

During manufacture, the backing is also printed with text and graphics which relate to the products to be delivered in the outer package containers. To relate to those products, the backing text and graphics are chosen to coordinate with text and graphics found on those products, or on the inner package containers which contain those products. This coordination of materials between the backing and the products to be delivered creates a uniform visual commercial impression which, in the preferred embodiments of the present invention runs from the body of the product, through the container which contains that product (generally one of a number of the inner package containers of that product) and, since the inner package containers may be seen through the plastic material from which the outer package container is made, or through windows in that material, right on to the adjacent backing which is attached to the outer package containers. And since the backing has two sides, that consistent commercial impression, which may be chosen by the product manufacturer, may occupy space on each side of the backing as large as the area of the back cover or the front cover of the selected publication. On the other hand, text and graphics on the back side of the backing may, in some embodiments of the present invention, duplicate the text and graphics on the back cover of the magazine, thereby preserving the advertising value of the back cover, which may already have been purchased by an advertiser.

The publication package covering means is an integral part of the present publication package invention because, as we note above, the covering means maintains the position of the outer package container backing against the back or front of the selected publication once the backing has been placed in one of those positions during the final assembly of the publication package. The covering means is gathered about the selected publication, the backing, and the outer package containers so as to hold these components in place with, in some embodiments, the edges of the backing approximately matching the position of the edges of the pages of the selected publication. Since the covering means is gathered, somewhat snugly in some embodiments, and since the backing also is affixed to the outer package containers, the outer package containers are also held in position against the front or back covers, or against the spine of the selected publication, so long as the covering means remains. Since the covering means is intended to be removed by a purchaser or consumer, the covering means thus remains in place surrounding the components of the publication package throughout transit by standard delivery means.

The covering means is in one preferred embodiment a thin and clear plastic "poly-bag." In other embodiments, the covering means may be opaque, to hide the front and back covers of the magazine. In yet other embodiments, the thin and clear plastic may be "shrink-wrapped" (shrunk to fit by heat) around the combination of the outer package containers (with backing) and the selected publication once these two pieces have been properly positioned one against the other. With such a shrink-wrap covering means, the backing of the outer package containers and the back cover of the selected publication (for instance) may be held "in register," so that the outer package containers which are affixed to the backing are positioned and held in place along one edge of the selected publication. However, other means of holding two objects, such as the outer package containers and backing and the selected publication, may be used, so long as they comply with the requirements imposed by standard delivery service suppliers.

While the present invention provides a facility for holding product containers and inner package containers within the publication package, such product containers and inner package containers are not themselves part of the present invention. However, in some embodiments of the present invention, the inner package containers which hold or contain the products to be delivered may fairly be said to be part of the present invention. In such cases, the inner package containers, which are formed to fit within the outer package containers of the publication package, are also formed in sizes suitable to each of the products to be delivered in the publication package. The inner package containers are also printed on their exterior, or text and graphics are otherwise impressed on their exterior, suitably for each of the products to be delivered in the publication package. This may be done by the product manufacturer or by the marketing company which supplies the inner package containers to the product manufacturer. The inner package containers may then be delivered by the publisher or marketing company to different product manufacturers for filling, and the publisher or marketing company may separately apply the matching (coordinated) text and graphics to the backing of the outer package containers.

Once the inner package containers have been filled by the manufacturer, and returned to the publisher or marketing company after filling, the inner package containers may then be placed within the outer package containers of the publication package in such a way as the inner package containers containing the product from each product manufacturer is situated within the outer package containers so that marketing text and graphics associated with that manufacturer on the exterior of the inner package containers is positioned over and closest to the marketing text and graphics associated with that same manufacturer on the backing of the outer package containers. In this way, the text and graphics of any single product manufacturer carry smoothly and consistently through each element of the publication package, from product, to product container (or inner package container, visually through the clear plastic or windows of the outer package containers), through the front of the backing (which may be situated against the back cover of the selected publication), and through the back of the backing (which may be visible through the covering means from the back side of the selected publication).

In some sense, then, the outer package containers, with their backing, and the inner package containers, are all pre-manufactured before their final assembly into the publication package of the present invention. Once they are pre-manufactured, the inner package containers or product containers are filled by the manufacturer or the marketing company, and returned to the marketing company or the publisher, which then places each inner package container in its proper position within each outer package container (on-register with the text and graphics of the backing of the outer package containers in some embodiments), and closes each outer package container to seal in the inner package containers or product containers. The marketing company or the publisher then performs the final assembly of the publication package of the present invention by positioning the backing of each outer package container against the front or back cover of the selected publication, with the outer package container along one edge of the selected publication in some embodiments, and covers the combination of outer package containers, backing and publication with the clear plastic of the publication package covering means. In some embodiments, the assembler then applies sufficient heat to "shrink wrap" the outer package container and backing to the selected publication. Once the final assembly of the publication package is completed in this way, the publication packages with enclosed publications may be handled just as any other publication by standard delivery services (for a small additional charge).

In another embodiment of the present invention, the outer package container contains one or more cut-out windows (or "windows") under which the products, or inner package containers, or product containers are visibly aligned, so that consumers wishing to purchase the selected magazine or one of the products contained within the outer package container may view its contents. This embodiment recognizes the desirability of providing a facility for consumers to view the actual products, or inner package containers, or product containers, before purchase through its unique alignment under the windows. The use of these windows in the outer package container allows consumers to view the actual products inside the outer package container, instead of asking consumers to imagine the actual appearance of the products when the outer package containers have no windows. The preferred embodiment of the present invention envisions the window or windows to be generally rectangular in shape. The outer package container with windows may be circular or generally rectangular (or generally square) or any other shape, so long as the consumers may view the contents within the outer package container. These windows can be cut out on the top, side, or bottom panels, including the corners of the outer package container. The preferred embodiment of the present invention envisions the outer package container to be made from lightweight cardstock because it is rigid yet modifiable enough so that windows can be cut out from the material of the outer package container. However, the material from which the outer package container is made should be resilient enough, and durable enough, to withstand some rough treatment when the selected publication is injected into the hands of standard delivery services, such as the United States Postal Service. The products, or inner package containers, or product containers, may be seen through the open windows, and even inserted through the open windows, and products and containers may also be taken out of the outer package container through its windows when the consumer opens the publication package. The products, or inner package containers, or product containers, may attach to the inside of the outer package container through an adhesive like glue. The open windows may remain open without any covering, or the windows may remain covered with a transparent material such as plastic. The outer package container may be left open at each end in some embodiments, and closed by suitable closure means at each end after filling. A simple means for closure is a plug, which may be fitted within the end of the outer package container, or a cap which may be fitted over the end of the outer package container. Another closure consists of at least one generally flat flap on one end (top and bottom) of the outer package container, which seals the contents securely inside the container when the top and bottom flaps are folded inwardly. However, closures may be as simple as perpendicular slits formed in the material of the outer package container near its ends, which allow folding of the material of the ends of the outer package container into its interior, to hold in place the inner package containers and products to prevent shifting of the containers or products during transit.

In another embodiment of the present invention, the samples may be inserted into open ends of the outer package container to align with their respective cut-out windows. In this embodiment, the windows under which products, or inner package containers, or product containers are placed are visibly aligned, so that consumers wishing to purchase the selected magazine or one of the products contained within the outer package container may view its contents. From the assembly standpoint, manufacturers can efficiently and quickly insert inner package containers into the open ends of the outer package container instead of placing each individual sample into its respective window. This embodiment recognizes the desirability of allowing consumers to view the products, or inner package containers, or product containers, before purchase through its unique alignment under the windows and for efficient manufacturing. The products, or inner package containers, or product containers can attach to the inside of the outer package container through an adhesive like glue. The use of these windows in the outer package container allows consumers to view the actual products inside the outer package container, instead of asking consumers to imagine the actual appearance of the products when outer package containers have no windows. The preferred embodiment of the present invention envisions the windows to be generally rectangular in shape. The outer package container may be circular or generally rectangular (or generally square) or any other shape, so long as the consumers may view the contents within the outer package container. These windows can be cut out on the top, side panels, or bottom panels, of the outer package container including the corners of the outer package container. The preferred embodiment of the present invention envisions the outer package containers made from lightweight cardstock because it is rigid yet modifiable enough so that windows can be cut out from the material of the outer package container. However, the material from which the outer package container is made should be resilient enough, and durable enough, to withstand some rough treatment when the selected publication is injected into the hands of standard delivery services, such as the United States Postal Service. The products, or inner package containers, or product containers, may be taken out of the outer package container through its windows when the consumer opens the publication package. The products, or inner package containers, or product containers, may attach to the inside of the outer package container through an adhesive like glue. The open windows may remain open without any covering, or the windows may remain covered with a transparent material such as plastic. The outer package container may be left open at each end in some embodiments, and closed by suitable closure means at each end after filling. A simple means for closure is a plug, which may be fitted within the end of the outer package container, or a cap which may be fitted over the end of the outer package container. Another closure consists of at least one generally flat flap on the ends (top and bottom) of the outer package container, which flap seals the contents securely inside the container when the top and bottom flaps are folded inwardly. However, closures may be as simple as perpendicular slits formed in the material of the outer package container near its ends, which allow folding of the material of the ends of the outer package container into its interior, to hold in place the inner package containers or products to prevent shifting of the containers or products during transit.

In yet another embodiment of the present invention, the outer package container may be formed to create a hollow space wherein a transparent drawer having six sides, and formed of plastic material, contains inner package containers or samples which may be inserted in the outer package container to then align with one or more windows when the entire drawer is inside the outer package container. In this embodiment, a drawer for use in the outer package container is comprised of a tray with six walls. The plastic drawer is moveable between an open position and a closed position. The preferred embodiment of the present invention envisions the drawer to be made from transparent plastic. The plastic walls of the drawer allows the consumer to view the actual products, or inner package containers, or product containers. The walls also provide interior support and housing of the products, or inner package containers, or product containers. Viewed from the top, the drawer comprises of a roof wall, bottom wall, a rear wall, a front wall, and two side walls. The roof wall, bottom wall, rear wall, front wall and two side walls are attached along their peripheral edges thereof. Drawers may include any of a variety of inserts, such as separators for the samples and sample containers. These inserts can be made of suitably rigid material such as lightweight cardstock or cardboard. The products, inner package containers, or product containers can be attached to the drawer by an adhesive like glue. Approximately matching the length of the selected publication and the drawer is desirable because movement of the drawer in relation to the selected publication is thereby reduced once the outer package container and the selected publication are "bundled" together within shrink wrap plastic or other means for holding the outer package container to the selected publication. The length of the drawer is also generally uniform in width along its length, and generally rectangular in cross section. This embodiment recognizes the desirability of providing consumers to view the samples through its unique alignment under the windows and for efficient manufacturing. For manufacturing purposes, the plastic drawer eliminates the need for the windows to remain covered with a transparent material such as plastic. Furthermore, from the assembly standpoint, manufacturers can efficiently and quickly insert products, inner package containers, or product containers into the open ends of the outer package container as well as avoid additional coverings in each window. The drawer may also have closing means as described above for the outer package container closures formed from the backing. The outer package container may be left open at each end in some embodiments, and closed by suitable closure means at each end after filling. A simple means for closure is a plug, which may be fitted within the end of the outer package container, or a cap which may be fitted over the end of the outer package container. Another closure consists of at least one generally flat flap on the ends (top and bottom) of the outer package container, which flap seals the contents securely inside the container when the top and bottom flaps are folded inwardly. However, closures may be as simple as perpendicular slits formed in the material of the outer package container near its ends, which allow folding of the materials of the ends of the outer package container into its interior, to hold in place the inner package containers to prevent shifting of the containers or products during transit.

In another embodiment of the present invention, the outer package container creates a hollow space wherein a transparent drawer having six sides, and formed from plastic material, may be inserted in the hollow space of the outer package container which contains a vertical strip (or "strip") to display advertising text and materials. Products, or inner package containers, or product containers may be placed or attached to the strip, so that consumers can easily pull out the strip to retrieve the inner package containers or samples. In this embodiment, the strip is an individual single sheet, which, in the preferred embodiment of the present invention, is made from lightweight cardstock, however all materials from which the strip may be made are within the scope of the present invention. The strip can also attach to the interior bottom panel of the outer package container through adhesive means such glue or have no attachment at all. Products, or inner package containers, or product containers can also be attached to the strip through adhesive means such as glue or have no attachment at all. The strip is formed about as long as the length of the selected publication, and about as wide as the width of the outer package container. The strip can be printed with text and graphics which relate to the products to be delivered in the outer package container. To relate to those products, the text and graphics are chosen to coordinate with text and graphics found on those products, or on the inner package container which contain those products. The outer package container may be left open at each end in some embodiments, and closed by suitable closure means at each end after filling. A simple means for closure is a plug, which may be fitted within the end of the outer package container, or a cap which may be fitted over the end of the outer package container. Another closure consists of at least one generally flat flap on the ends (top and bottom) of the outer package container, which seals the contents securely inside the container when the top and bottom flaps are folded inwardly. However, closures may be as simple as perpendicular slits formed in the material of the outer package container near its ends, which allow folding of the material of the ends of the outer package container into its interior, to hold in place the inner package containers or products to prevent shifting of the containers during transit.

In another embodiment of the present invention, rigid material (or "rigid inserts") formed by cutting a blank of stiff, strong material such as corrugated cardboard can be inserted inside the outer package container to prevent any compromise or shifting of the samples and sample containers during transit. In this embodiment, the products, or inner package containers, or product containers is supported completely in relation to the placement of the rigid inserts inside the outer package container. The rigid inserts may be inserted vertical and parallel to the length of the outer package container or horizontal and parallel to the width of the outer package container. The rigid inserts exhibit adequate strength for shape and size. Other lightweight materials may be specifically selected for special purposes such as rigidity and stiffness. Materials are of sufficient rigidity to properly maintain and support the products, or inner package containers, or product containers during handling and shipment. The rigid inserts also prevent movement of the products, or inner package containers, or product containers therein. The rigid inserts may also preferably be about as long as the selected publication is long or as wide as the width of the outer package container. The preferred embodiment of the present invention envisions coplanar rigid material that is inserted perpendicular or parallel to the hollow space inside the outer package container. Approximately matching the length of the selected publication, the rigid material is desirable to ensure all products, or inner package containers, or product containers do not shift during transit. The outer package container which houses the rigid inserts may be left open at each end in some embodiments, and closed by suitable closure means at each end after filling. A simple means for closure is a plug, which may be fitted within the end of the outer package container, or a cap which may be fitted over the end of the outer package container. Another closure consists of at least one generally flap on the ends (top and bottom) of the outer package container, which flap seals the contents securely inside the container when the top and bottom flaps are folded inwardly. However, closures may be as simple as perpendicular slits formed in the material of the outer package container near its ends, which allow folding of the material of the ends of the outer package container into its interior, to hold in place the inner package containers to prevent shifting of the containers or products during transit.

In another embodiment of the present invention, a perpendicular slit ("the slit") may be formed near its ends of the outer package container which acts as a closure, thereby holding in place the products, inner package containers, or product containers to prevent shifting of the containers during transit. In this embodiment, the closures may be as simple as perpendicular slits formed in the materials of the outer package container near its ends, which allow folding of the materials of the ends of the outer package container into its interior, to hold in place the products, inner package containers, or product containers to prevent shifting of the items during transit. Though a simple means for closure is a plug, which may be fitted within the end of the outer package containers, or a cap which may be fitted over the end of the outer package containers, closures may be as simple as perpendicular slits formed near its ends of the outer package container. Near each end of the outer package container, a slit is made by cutting one corner of the outer package container. For an outer package container that is folded outwardly from the backing, the slit is made by cutting the corner comprising the third and fourth side wall of the outer package container. For an outer package container that is folded inwardly from the backing, the slit is made by cutting the corner comprising the second and third side wall of the outer package container. The slit can be cut at any width desirable yet sufficient to hold the products, or inner package container, or product containers. Once the slit is made, the corners of the slit are folded inwardly and perpendicularly to the bottom side wall of the outer package container. The slit is folded at a perpendicular angle so as to facilitate a means for holding and locking in the ends of the inner package containers or products near its ends of the outer package container.

In another embodiment of the present invention, an advertising card (or "double card") can function as a book cover and provide additional advertising space. Like the conventional structure of a book, the book cover has three sides which have a front cover, a spine side, and a bottom cover in this embodiment. The outer package container is positioned against the spine inside the cover of the double card. The outer package container and selected publication is held in position so long as the double card remains. The double card holds the outer package container and selected publication in place while the package is in transit with or without attachment means. A means for adhering the double card to the outer package container and selected publication can be by any means of an attachment, such as an adhesive, or staples. However, the double card need not be attached to the package container and selected publication because the outer package container and selected publication is held in position so long as the double card stays in position against the front and back of the selected publication. The double card can be flipped opened in a right-to-left fashion, just as one would flip a book cover open from left to right. Alternatively, the double card can be placed on the opposite side of the publication and flipped open in a left-to-right fashion. This alternative placement of the double card is used in countries such as Japan, where reading materials are opened in a left-to-right fashion.

The preferred embodiment of the present invention envisions the double card to be made from lightweight cardstock, however all materials from which the double card may be made are within the scope of the present invention. The front cover, spine, and back cover of the double card can be about as long as the length of the selected publication or shorter, and about as wide as the width of the selected publication, and the binding of the selected publication. With the width about the same as a spine of the selected publication, the double card will tend to stay in position against the front and back of the selected publication in transit, so long as the double card encloses the outer package container and the selected publication. Additional means to secure the double card, selected publication, and outer package containers may include, but are not limited "poly-bagging," or "shrink wrap," or other outer cover means.

All three sides of the double card in the preferred embodiment of the present invention may bear additional marketing text and graphics which are coordinated with the graphics of the inner package containers and the backing. The double card may also be printed with text and graphics which relate to the products to be delivered in the outer package container. To relate to those products, the double card text and graphics may be chosen to coordinate with text and graphics down on those products, or on the inner package container which contains those products. And since the double card has three sides, that consistent commercial impression, which may be chosen by the product manufacturer, may occupy space on each side of the double card as large as the area of the back cover or the front cover of the selected publication. On the other hand text and graphics on the back cover of the double card may, in some embodiments of the present invention, duplicate the text and graphics on the back cover of the selected publication, thereby preserving the advertising value of the back cover, which may already have been purchased by the advertiser. The product manufacturer can maximize advertising space with the publication package of the present invention. All of this advertising space is viewable from the back of the publication (on the back of the book cover) when in transit, and on the front of book cover.

In another embodiment of the present invention, a sleeve with three sides (or "sleeve") can also function as a book cover and provide additional advertising space. Like the conventional structure of a book, the book cover includes three sides which have a front cover, a spine side, and a bottom cover in this embodiment. The sleeve enwraps around the publication package comprising of the selected publication and one outer package container placed vertically against each vertical end of the bottom cover. The front cover and bottom cover are formed about as long as the length of the selected publication, and about as wide as the width of the selected publication, including the binding of the selected publication if any. The sleeve holds the outer package containers and selected publication in place while the package is in transit with or without attachment means. A means for adhering the sleeve to the outer package container and selected publication can be by any means of an attachment, such as an adhesive or staples. The sleeve also adequately protects the face of the publication package during shipping and handling. Like a book cover, the sleeve enwraps and embodies the structural arrangement by which the sleeve may be folded about the publication package. The sleeve is wrapped around the publication package, such that the cover, spine, back, and opening edge of the selected publication are covered except for the horizontal edges of the selected publication and horizontal and outer vertical side walls of the outer package containers. The sleeve is an individual single sheet, which, in the preferred embodiment of the present invention, is made from lightweight cardstock, however all materials from which the sleeve may be made are within the scope of the present invention. After the sleeve is folded around the publication package, the sleeve can be flipped opened in a right-to-left fashion, just as one would flip a book cover open from left to right. Alternatively, the sleeve may be placed on the opposite side of the publication and flipped open in a left-to-right fashion. This alternative placement of the sleeve is used in countries such as Japan, where reading materials are opened in a left-to-right fashion.

The preferred embodiment of the present invention envisions the sleeve to be made from lightweight cardstock, however all materials from which the sleeve may be made are within the scope of the present invention. The front cover, spine side, and the bottom cover of the sleeve can be about as long as the length of the selected publication or shorter, and about as wide as the width of the selected publication, and the binding of the selected publication. With the width about the same as a spine of the selected publication, the sleeve will tend to stay in position against the front and back of the selected publication in transit, so long as the sleeve encloses the outer package container and the selected publication. Additional means to secure the sleeve, selected publication, and outer package containers may include, but are not limited "poly-bagging," or "shrink wrap," or other outer cover means.

When wrapped around the publication package, all three sides of the sleeve are printed with text and graphics which relate to the product to be delivered in the outer package container. To relate to those products, the text and graphics are chosen to coordinate with text and graphics found on those products, or on the inner package container which contain those products. And since the sleeve has three sides, that consistent commercial impression, which may be chosen by the product manufacturer, may occupy space on each side of the sleeve as large as the area of the back cover or the front cover of the selected publication. On the other hand text and graphics on the back cover of the sleeve may, in some embodiments of the present invention, duplicate the text and graphics on the back cover of the selected publication, thereby preserving the advertising value of the back cover, which may already have been purchased by the advertiser. The product manufacturer can maximize advertising space with the publication package of the present invention. With the width about the same as a spine of the publication package, the publication package will tend to stay in position while it is in enwrapped by the sleeve in transit, so long as the sleeve encloses the package without having its ends detached.

In another embodiment of the present invention, a sealed sample bag (or "sample bag") containing a sample or sample container and advertising card can be placed along with the publication package and held in place by the publication package covering means, such as a poly-bag or a shrink-wrap. In this embodiment, the sample bag can also be attached to the selected publication by means of an attachment, such as an adhesive, or staples. The covering means maintains the position of the outer package container, backing, and the sample bag. The sealable, sample bag has of a sample or sample container and advertising card. The preferred embodiment in the present invention envisions the sample bag to be rectangularly-shaped and made from clear plastic, so that potential consumers wishing to purchase the selected magazine or the sample or sample container inside the sample bag may view its contents. However, the embodiment may have only the advertising card and the sample or sample container attached to card by means of an attachment, such as an adhesive or staples. Additional means to secure the advertising card, sample or sample container may include, but are not limited "poly-bagging," or "shrink wrap," or other outer cover means. The advertising card is printed with text and graphics on its front which relate to the sample or sample container. The back of the card may also be printed with text and graphics so as to maximize advertising space. The advertising card can be of any length, width, and shape. The preferred embodiment of the present invention envisions the advertising card to be made of lightweight cardstock, however, all materials from which the advertising card may be made are within the scope of the present invention.

In another embodiment of the present invention, a thermoformed, flat back packaging sample (or "sample pod") containing a liquid-holding sample can be attached to the backing of the publication package. In this embodiment, the sample pod can also be placed separately somewhere within the publication package and held in place by the publication package covering means, such as a poly-bag or a shrink-wrap. The covering maintains the position of the outer package container, backing, and the sample pod. The sample pod can be attached to any of the backing's outer vertical or horizontal edges of the selected publication package or selected publication by means of an adhesive, such as glue or staples. The placement of the sample pod on the backing's outer vertical or horizontal edge allows the selected publication to be held in place between the outer package container and the sample pod. The sample pod is made from sustainable, thermoformed material with high stiffness, good compression strength and processability to withstand any leakage during heavy handling or shipment of the pod. The flat back packaging of the pod allows the maximal surface area to be in contact with the surface to which the pod is attached with an adhesive. The sample pod can be of any length, width, and shape. The preferred embodiment in the present invention envisions the sample pod to be made from plastic. The sample pod may also be made from transparent material, so that potential consumers wishing to purchase the selected magazine may view the sample pod's contents. The sample pod may be printed with text and graphics on its front which relate to the liquid sample. The back of the sample pod may also be printed with text and graphics so as to maximize advertising space. The preferred embodiment of the present invention envisions the sample pod to be made of plastic, however, all materials from which the sample pod may be made are within the scope of the present invention. The thermoformed film parts can be heat-sealed, bonded, or welded together and attached with at least one closure such as a weldspout fitment or any other fitment known to those skilled in the art. A thermoforming process can include thermoforming, vacuum forming, twin sheet thermoforming, pressure forming or hot air blow forming of a film into a shaped and sculpted form.

Several patents have been directed to the promotion of advertising goods, or to the incorporation of goods within a publication, and so they are prior art. For example, U.S. Pat. No. 1,848,980 to Walker discloses a pencil holder adapted to engage the grooves of the binding of a book. However, Walker requires the use of a semicircular tube open on one side, as opposed to a tube which is totally enclosed, with a hinged latch at one end. As a result, a publication incorporating Walker would be damaged in the event that a liquid sample were to burst inside Walker's holder.

U.S. Pat. No. 4,968,061 to Bullard Jr. discloses an advertising booklet which is adapted to hold a sample of the goods being advertised through a plurality of slots extending partially through the pages. The invention disclosed in Bullard is impractical for use in a magazine for a variety of reasons, particularly when the sample intended to be delivered is a fluid. However, regardless of the form of the sample, the sample cutout of Bullard extend through most of the subject magazine, thereby affecting other text and graphics adversely.

U.S. Pat. No. 5,209,349 to Porter et al. discloses an apparatus for distributing product samples to consumers along with a publication through a display container positioned on the front or back of the publication. The display container in turn is formed with recess windows, in which the sample products are placed, and publication, and the display container, with sample products situated within its recessed windows, is encapsulated with clear plastic in a shrink-wrap process. While the invention of Porter requires shrink-wrapping as in the present invention, the display container of Porter substantially increases the thickness of the magazine, and prevents viewing of the front or back cover of the magazine at a newsstand. Further, should the shrink-wrap of Porter tear, the samples within the display container would be lost.

U.S. Pat. No. 5,716,075 to Evert discloses a device and method for the packaging and distribution of sample products to consumers along with a publication, whereby said product samples are enclosed within product sample holders and inserted into a rectangular tube made of transparent plastic material having at least one planar surface. The planar surface of the rectangular tube is then secured against the square binding of a magazine or publication by means of clear adhesive tape, thereby allowing the product samples to be distributed to magazine subscribers or at newsstands. The invention disclosed in Evert is an advance over prior art in the field of sample delivery by means of subscription publications. In particular, Evert allows the delivery of such samples with a publication without increasing the thickness of the publication, and without obscuring the front or back of the publication. However, the shortcomings of the Evert invention, and three of the large differences between the Evert invention and the present publication package invention, may be found in the means for holding that durable outer tubular container to the publication used for its delivery, and in the character of the tube found in Evert in light of the materials from which it is made. We turn now to these two subjects.

The tape holding means disclosed in Evert necessarily implies some instability in positioning between Evert's tube, positioned lengthwise adjacent to the binding of publication 60, using clear adhesive tape. As Evert explains, two strips of adhesive tape are applied at opposite ends of tube to properly secure tube in place and to prevent detachment during shipping. However, Evert teaches that the number of strips of adhesive tape which are to be utilized may vary, dependent upon the length and thickness of magazine/publication. This leads us to the conclusion that the length, width, or mass of tube may mean instances in which stability between tube and magazine requires more of tape to "properly secure tube." Standard delivery services, and even newsstands, also put extraordinary stresses on publications such as magazines during shipment, and mere tape simply cannot provide the stability of the shrink-wrap encapsulation of the present invention. Mere tape also cannot provide the weather and dirt protection of the poly-bag or shrink-wrap encapsulation of the present invention.

Moreover, U.S. Postal rates vary, from inexpensive "book rate" for publications, to much more expensive "first class rate" for "regular" mail. While regular mail may be used for delivery of product samples, mailing at first class rates is very expensive and so, in many instances, cost prohibitive. Book rate, on the other hand, allows publishers and advertisers to utilize the dramatically lower rates established by Congress for publications to deliver product samples, but only if the publisher or advertiser meets U.S. Postal Service regulations for delivery of publications. Evert does not meet such regulations, because the U.S. Postal Service will charge first class rates on publications if any item is attached to such publications. Thus, while the invention of Evert may work for its intended purpose, it is not cost effective. The publication package of the present invention, on the other hand, does not require anything to be attached to the delivered publication, but instead encloses all components in covering means such as poly-bag or shrink-wrap, thereby meeting U.S. Postal Service regulations. As a result, sample products delivered with publications using the device and method of the present invention are delivered at book rates, with a "ride-along" surcharge. This rate allows delivery at dramatically reduced cost.

Evert also discusses "protecting" samples during shipping, but does not say how such samples are protected. In fact, Evert discusses protecting samples during shipping only in the context of its product containers consisting of rectangular cardboard boxes or carded blister pack containers. However, cardboard boxes and blister packs are not generally considered durable or resilient of shocks and forces exerted during shipment, and are nothing like the rigid plastic outer package container of the present invention, which is specifically engineered to protect product samples from damage, breakage, and leakage.

Finally, the tape holding means disclosed in Evert also necessarily implies limitations on front and back cover advertizing, advertizing Evert calls "a prime source of advertising revenue." Evert uses clear adhesive tape because such tape prevents the front cover of the magazine from being obscured, thereby preserving the aesthetic newsstand appeal of the publication. Evert also teaches that the tape may easily remove the holder from the magazine by grasping the tube and removing the adhesive tape by the non-adhesive center strip of adhesive tape. These, of course, are additional processes necessary to gaining access to the samples Evert intends to deliver, which potentially do not "prevent alteration or modification to the back cover of the magazine," as Evert claims.

A review of the prior art disclosed above indicates that while there have been numerous attempts to devise a means for distributing product samples along with a publication, there remain inherent problems with each one. These devices therefore lack the desired benefit of providing an inexpensive, efficient and standardized means for placing product samples in the hands of magazine subscribers or readers while not adversely affecting the appearance and/or size of the subject publications. The present publication package invention avoids all of these problems, and provides entirely new functionality and marketing capabilities with the additional advertising space located on the backing of the outer package container.

More specifically:

1. The backing may be formed of high quality material, most suitable for printing high quality images and texts. If we consider the difference between even slick magazine grade single-page paper, upon which an advertisement may be placed, and hard and smooth cardstock used for playing cards, we can appreciate that cardstock for playing cards may be handled in ways even high quality magazine grade paper may not. Also, cardstock for playing cards may take printing and preservation processes that magazine grade paper may not. As a result, the backing of the present invention may not only be keyed to the outer and inner package containers, but the backing may be printed in ways which create exceptional, one-of-a-kind advertising impact. As a result, advertising images on the backing may have an advertizing impact and advantage over and above even those images usually allocated to the front and back covers of a magazine.
2. Since the outer package container and the backing are first separated from the selected publication, and since the front of the backing is also printed with high quality text and images, the consumer subscriber is exposed to the front of the backing much as she would be exposed to the front of the magazine. In some sense, the front of the backing has even more interest, as the graphics on the front of the backing lead the consumer naturally to the samples to be delivered in the outer package container, and allow the eyes of the consumer to linger over the high impact images on the front of the backing until the consumer can open the outer package container, and remove all inner package containers containing samples. Thus, the front of the backing is exposed separately from the front and back of the magazine, thereby creating a second "front cover" (and a second "back cover"), for multiple images in these highly desirable positions in magazine trade.

The more important features of the invention have thus been outlined, rather broadly, so that the detailed description thereof that follows may be better understood, and in order that the present contribution to the art may be better appreciated. Additional features of specific embodiments of the invention will be described below. However, before explaining preferred embodiments of the invention in detail, it may be noted briefly that the present invention substantially departs from pre-existing apparatus and methods of the prior art. In so doing, the present invention provides publishers with the highly desirable ability to add marketing images and texts to their magazines and, at the same time, provides fragrance manufacturers with the highly desirable ability to deliver samples of their products to targeted potential customers.

Objects of the Invention

One object of this invention is to provide a holder which may be used for distributing sample products and promotional materials.

Another object of this invention is to provide such a holder that may accompany a magazine or other publication of any size, that is, of any width, length, or thickness.

Another object of the present invention is to provide such a holder adapted for use in distributing sample materials to a selected sample of the public, therefore providing an efficient utilization of marketing resources.

Another object of the present invention is to provide such a product sample holder that may be economically produced in mass quantities.

Another object of the present invention is to provide such a holder that may hold product containers in a variety of lengths, so that different volumes of product may be delivered with such publication, and in which such product containers may be formed to hold fluids intended for delivery, along with sprayers for such fluids.

Another object of the present invention is to provide such a holder that may be used with a variety of publications.

Another object of the present invention is to provide such a holder that may be distributed by a publisher or advertiser with products which are consistent with the theme of the subject publication, and coordinated with its advertising.

Another object of the present invention is to provide such a holder that fits alongside the binding of the publication, or alongside any similar edge of the publication, allowing copies of the publication to be easily stacked without damaging the holder or the publication, and at the same time allow the publication to be folded, or rolled into a tube, and to be inserted in any USPO approved mail box.

Another object of the present invention is to provide such a holder that may be formed of a clear plastic which allows for easy and quick identification of the particular products delivered in the holder, thereby providing both increased impact on potential consumers as well as additional incentive for prospective newsstand customers to purchase the publication.

Another object of the present invention is to provide such a holder that is affixed to a backing having the approximate width and length of the magazine or publication, which backing may be situated against the back or front cover of the magazine, and held in that position by a plastic covering, including a plastic cover which encloses the holder and backing and magazine in a plastic poly-bag or shrink-wrap process, to keep the holder and backing in register position against the back or front cover of the magazine so the holder remains in place along one edge of the magazine or publication.

Another object of the present invention is to provide such a holder, with backing, that may be easily and fully separated from the subject publication without harming the text or artwork on the front cover, the back cover, or the spine.

Another object of the present invention is to provide such a holder of product samples and promotional materials that may act as incentives to purchase the subject publication over other publications on display, therefore increasing the sales of the publication.

Another object of the present invention is to provide such a holder that consists of a fully enclosed, durable and resilient, tube, thereby ensuring excellent protection of the product samples delivered in the holder, as well as an effective means of protecting the products and product containers from tampering.

Another object of the present invention is to provide such a holder having a backing formed of high quality material, most suitable for printing high quality images and texts, which may be keyed to the outer and inner package containers, or the samples themselves, in ways which create exceptional, one-of-a-kind advertising impact.

Another object of the present invention is to provide such a holder in which the outer package container and the backing are first separated from the selected publication. This separation exposes a consumer or subscriber to the front of the backing, much as she would be exposed to the front of the magazine, thereby allowing the graphics on the front of the backing, which are coordinated to the graphics on inner package containers, to lead the consumer naturally to the samples to be delivered in the outer package container. This also allows the eyes of the consumer to linger over the high impact images on the front of the backing until the consumer turns to the outer package container, to remove inner package containers or samples.

Another object of the present invention is to provide quicker and efficient manufacturing of such a holder that is formed and adjoined from the backing, the material of which is folded inwardly or outwardly to form the outer package container comprising a rectangular or tubular body having four walls. With such arrangement, time and materials are saved and not expended in the manufacture of a separate outer package container and backing.

Another object of the present invention is to provide such a holder in which there are two outer package containers at each vertical end of the backing, or tray embodiment, which functions as a receptacle of the selected publication which is placed snugly against the backing between the two outer package container, and holds the selected publication firmly in place during transit, and allows the publisher or marketing company to provide a larger variety of product samples as opposed to using one outer package container to house the product samples.

Another object of the present invention is to provide such a holder in which the outer package containers formed inwardly or outwardly from the backing may vary in width, thickness, and shape to accommodate the size of the product samples inserted inside such containers.

Another object of the present invention is to provide such a holder with a separate, outer package container that is attached to the outer package container adjoined to the backing, and the separate, outer package can be interchanged positionally and can be placed outside and left of the outer package container or alternatively, the separate, outer package can be placed between the outer package container and the selected publication, so that the marketing company or publisher is able to provide a larger variety of product samples and ad space for consumers.

Another object of the present invention is to provide such a holder with a moveable drawer inserted in the outer package container and provide interior support of the outer package container and housing of the inner package containers.

Another object of the present invention is to provide a strip inserted in the transparent, closed topped six-sided plastic drawer of the outer package container for purposes of displaying advertising text and materials on the strip and for consumers to easily pull out the strip to retrieve the inner package containers or samples on the strip.

Another object of the present invention is to provide such a holder with a outer package container containing cut-out windows under which the inner package containers or samples are visibly aligned, so that consumers wishing to purchase the selected magazine or one of the products contained within the outer package container may view its contents, and this embodiment recognizes the desirability of providing consumers to view the actual samples through its unique alignment under the windows.

Another object of the present invention is to provide such a holder with rigid material inserted inside the outer package container to avoid any shift and compromise of the inner package containers inside the outer package container during transit by delivery and to reinforce the compact arrangement of the inner packages.

Another object of the present invention is to provide such a holder having a perpendicular slit ("the slit") formed by both ends of the outer package container and folded inwardly inside such container to hold in place the inner package containers to prevent shifting during transit.

Another object of the present invention is to provide such a holder having a double card which can provide more textual and graphic advertising space and hold the outer package container and selected publication in position so long as the double card remains, and provide more textual, advertising space.

Another object of the present invention is to provide such holder having a sleeve which can provide more textual and graphic advertising space and hold the publication in position while it is in enwrapped by the sleeve.

Another object of the present invention is to provide such holder having a sealed, sample bag comprising of a sample or sample container and advertising card, so that potential consumers wishing to purchase the selected magazine or the sample or sample container inside the sample bag may view its contents, and the advertising card allows for more textual and graphic advertising space which relate to the sample or sample container.

Another object of the present invention is to provide such a holder having a thermoformed, flat back packaging sample pod containing the liquid-holding sample that can be attached to the backing of the publication package, so that consumers can try samples that are in liquid form and not subject to leakage because the sample pod is made from sustainable, thermoformed material with high stiffness, good compression strength and processability to withstand any leakage during heavy handling or shipment of the pod.

BRIEF DESCRIPTION OF DRAWINGS

The accompanying drawings, which are incorporated in and constitute a part of this specification, illustrate preferred embodiments of the present invention, and such drawings, together with the description set forth herein, serve to explain the principles of the invention.

DETAILED DESCRIPTION OF EMBODIMENT

First Preferred Embodiment

Figure 1:
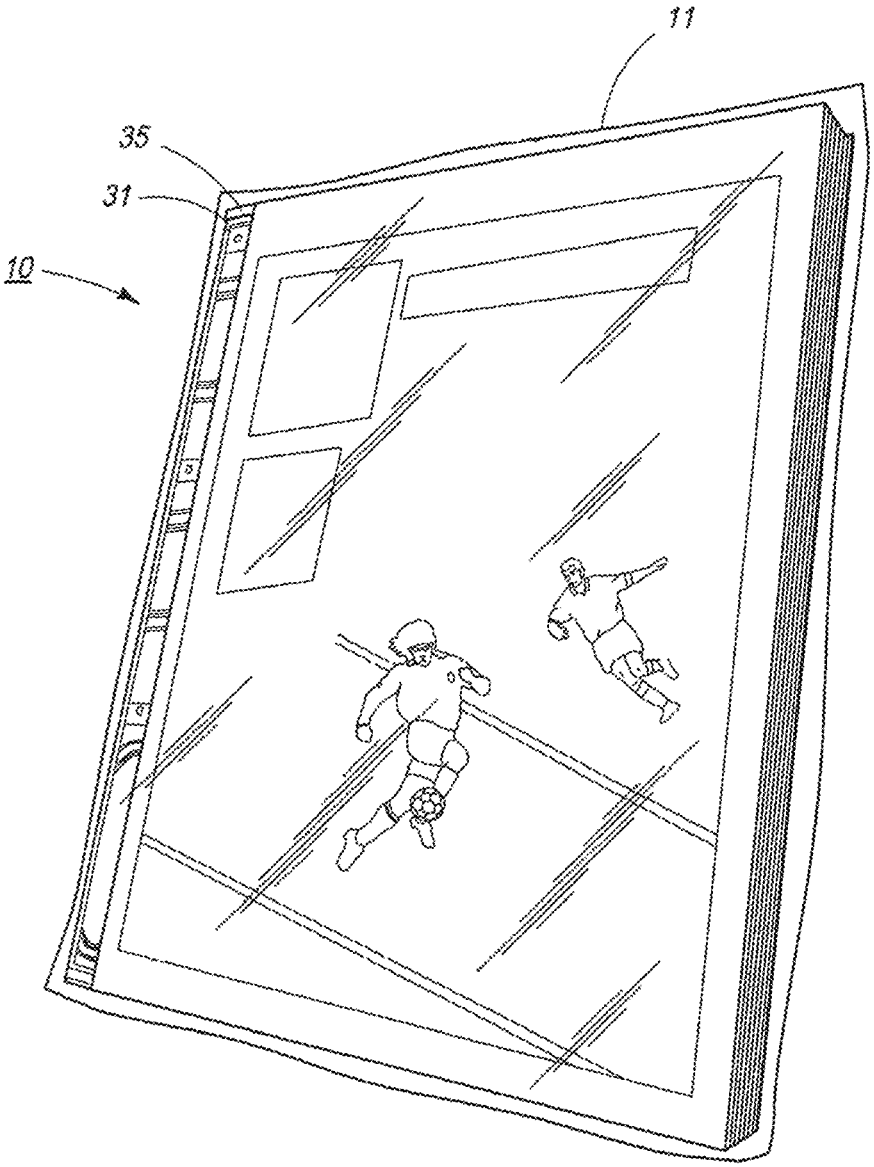
FIG. 1 is a perspective view drawing of a first preferred embodiment of the publication package of the present invention, viewed from the front cover, with publication package poly-bagwrap covering means.

Referring initially to FIG. 1, a first embodiment of publication package 10 of the present invention is shown in perspective, as it has been wrapped in plastic shrink-wrap covering means 11. In FIG. 1, various components of publication package 10 may be viewed through shrink-wrap covering means 11, however those components may not generally be accessed until such time as shrink-wrap covering means 11 is removed from publication package 10. Upon removal of shrink-wrap covering means 11, the consumer may separate the components of publication package 10, and also access the products to be delivered. Until delivery to the consumer is complete, all components are contained within, and protected from dirt and weather by, shrink-wrap covering means 11. In this configuration, publication package 10 may be handled by distributors just as any other publication may be handled, and stacked for storage. In this configuration, shrink-wrap covering means 11 also hold components of publication package 10 together, and in proper "register" one to the other, so that individual copies of the chosen publication may be stacked, and handled just as any other publication, shifting components of publication package 10 within shrink-wrap covering means 11, or adversely affecting their condition. However, even as shrink-wrap covering means 11 protects the contents of publication package 10, and before shrink-wrap covering means 11 is removed, the title of the chosen publication, all of the front cover of that publication, and most other components of publication package 10 contained within shrink-wrap covering means 11 are viewable by distributors and consumers.

Figure 2:
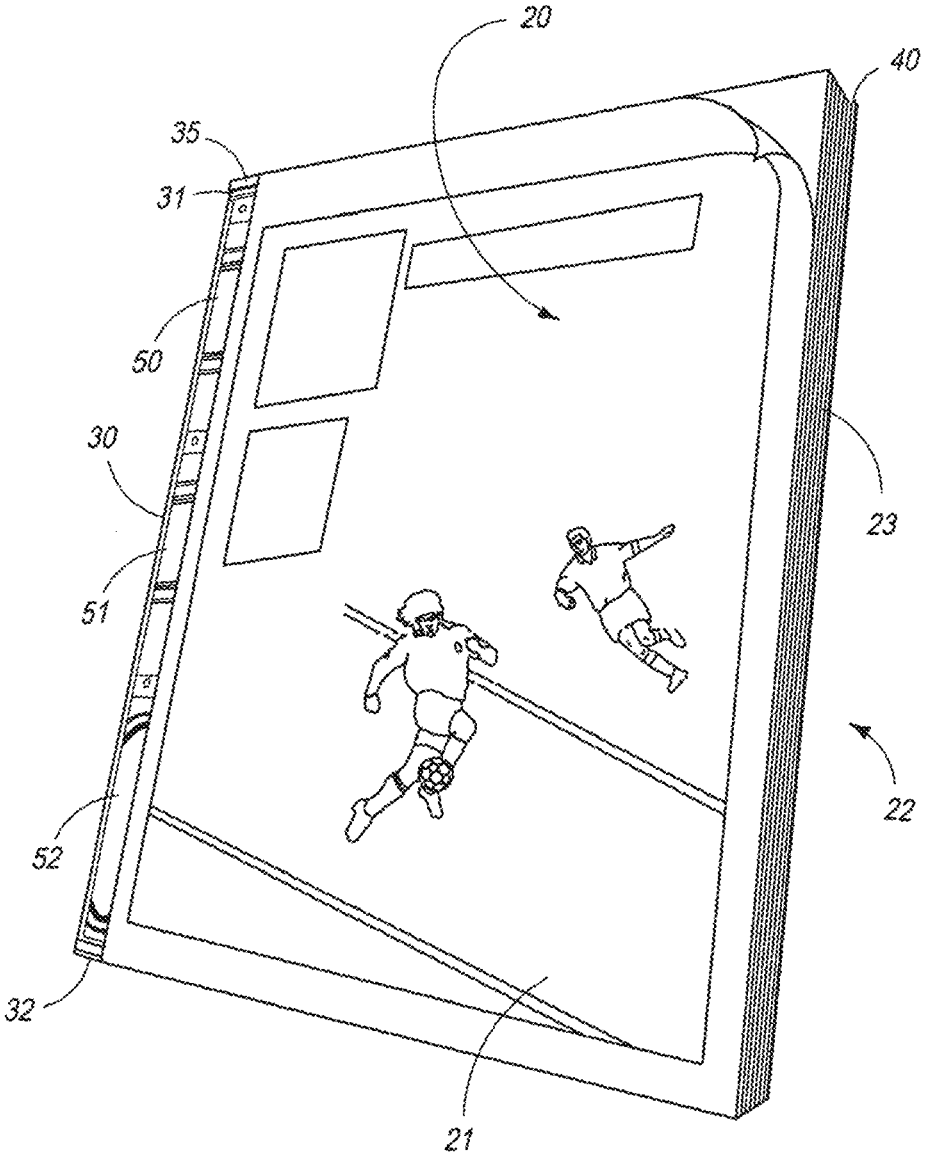
FIG. 2 is a perspective view drawing of a first preferred embodiment of the publication package appearing in FIG. 1, viewed from the publication front cover and page edge sides.

Turning now to FIG. 2, a first embodiment of publication package 10 of the present invention is shown in perspective, and for clarity without shrink-wrap covering means. Thus, publication package 10 may now be appreciated in its condition after deliver to a consumer, and after shrink-30 wrap 11 has been removed. In FIG. 2, publication package 10 has attached to it selected publication 20, viewed from selected publication 20 front cover 21 side. Selected publication 20 page opening edge 22 may be seen, along with edges of individual pages 23 of selected publication 20. In this case, selected publication 20 is a magazine, however publication package 10 may be utilized to distribute products by accompanying a variety of publications. Outer package container 30 of publication package 10 may also be seen, formed in a regular, tubular shape, with outer package container 30 top end 31 and outer package container 30 bottom end 32. In FIG. 2, a first generally flat side (not shown) of outer package container 30 is positioned against spine edge 24 of selected publication 20. A second generally flat side 34 (shown in FIG. 3) of outer package container 30 is affixed to publication package 10 backing 40 (not fully shown), and backing 40 is positioned against the back cover 25 of selected publication 20. Outer package container 30 is formed of clear plastic in this embodiment, and three (in this embodiment) ipcs, inner package container 50, inner package container 51, and inner package container 52, may be seen through the plastic of outer package container 30. Inner package containers 50 through 52 are positioned snugly within outer package container 30 in such a way that graphics, which may appear on the exterior sides of inner package containers 50 through 52 may be viewed through the clear plastic of outer package container 30. In FIG. 2, we may not see outer package container 30 closure means, however, outer package container closure means resides within or around outer package container 30 top end 31, to close outer package container 30 top end 31 once inner package container 50 through inner package container 52 have been placed within outer package container 30.

Figure 3:
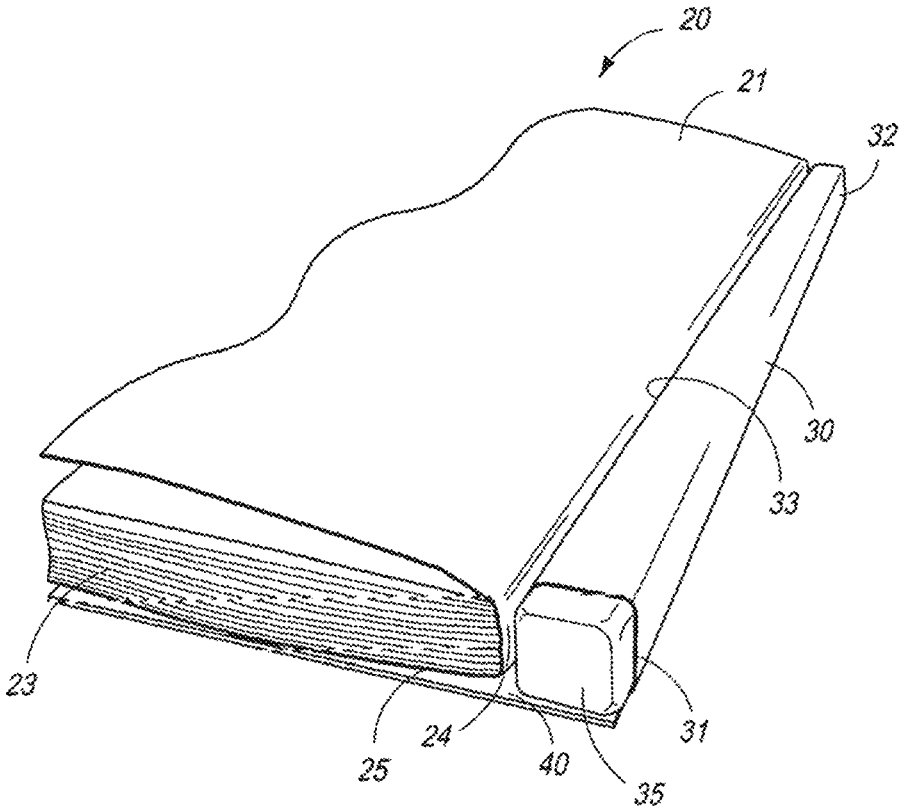
FIG. 3 is a perspective view closeup drawing of the first preferred embodiment of the publication package appearing in FIG. 1, viewed from the front cover and outer package container top end, with outer package container closure means in the form of a plug fitted within the end of the outer package container.

In FIG. 3, only a portion of the first embodiment of publication package 10 of the present invention shown in FIG. 1 appears in perspective, again without shrink-wrap covering means for clarity. That portion of publication package 10 which appears in FIG. 3 is outer package container 30, end-on, from outer package container 30 top end 31. Again in FIG. 3, publication package 10 has attached to it selected publication 20, viewed from selected publication 20 front cover 21 side. Again, the edges of individual pages 23 of selected publication 20 may be seen, and again outer package container 30 of publication package 10 may be seen formed in a regular, tubular shape, with outer package container 30 top end 31 and outer package container 30 bottom end 32. Thus, FIG. 3 shows a portion of publication package 10 as it resides within shrink-wrap 11, and as it appear to a publication purchaser if she removed shrink-wrap 11 from publication package 10, and rotated outer package container 30 and selected publication 20 together to view outer package container 30 from outer package container top end 31. In FIG. 3, first generally flat side 33 of outer package container 30 may be seen positioned against spine edge 24 of selected publication 20. Second generally flat side (not shown) of outer package container 30 is affixed to publication package 10 backing 40, and backing 40 is positioned against back cover 25 of selected publication 20. While outer package container 30 is formed of clear plastic in this embodiment, inner package container 50 through 52 are omitted from FIG. 3 for clarity, along with the shrink-wrap covering means. However, in the normal course inner package container 50 through 52 (in this embodiment; additional inner package containers may be used in other embodiments) reside within outer package container 30 when the publication is in transit, being delivered to a consumer or subscriber in shrink-wrap 11. We may also see outer package container 30 closure means 35 (in this case a plug), fitted snugly within outer package container 30 top end 31, thereby closing outer package container 30 top end 31 with inner package containers 50 through 52 (not shown) residing within outer package container 30.

Figure 4:
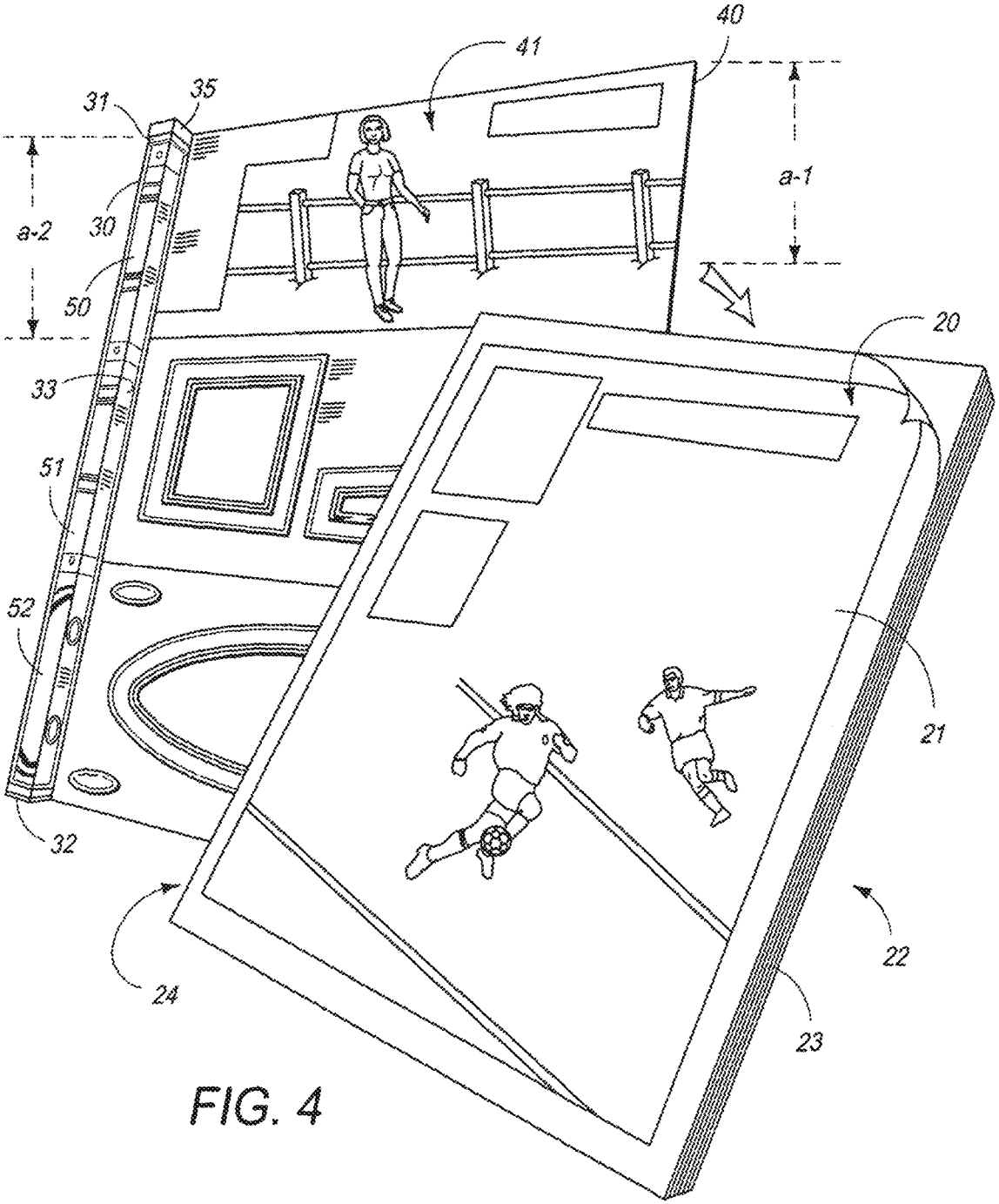
FIG. 4 is a perspective view drawing of the first preferred embodiment of the publication package appearing in FIG. 1, viewed from the front cover side, in which the outer package container, with attached backing, has been partially separated from the selected publication.

In FIG. 4, the first embodiment of publication package 10 of the present invention shown in FIG. 1 appears again in perspective, again without shrink-wrap covering means, which has been removed by the consumer. In FIG. 4, selected publication 20 is no longer attached to outer package container 30 of publication package 10, and selected publication 20 has been separated from outer package container 30 by pulling spine edge 24 of selected publication 20 away from first generally flat side 33 of outer package container 30. Again we may see in FIG. 4 selected publication 20 front cover 21, selected publication 20 page opening edge 22, and edges of individual pages 23 of selected publication 20. Again outer package container 30 is seen as a regular, tubular shape, with outer package container 30 top end 31 and outer package container 30 bottom end 32. Since selected publication 20 has been separated from outer package container 30, we may see in FIG. 4 first generally flat side 33 of outer package container 30 is no longer positioned against spine edge 24 of selected publication 20, and second generally flat side (not shown) of outer package container 30 affixed to backing 40.

Of particular importance in FIG. 4, as backing 40 is no longer positioned against the back cover of selected publication 20, we may for the first time see text and graphics (collectively the "Front Indicia") arrayed on the front side 41 of backing 40. The Front Indicia is broken into sections over the area of front side 41 in this embodiment in such a way as to enhance the marketing impact for consumers who purchase selected publication 20. This is accomplished through (I) the choice of materials from which backing 40 is formed, and through (ii) coordination of Indicia appearing on front side 41 with similar text and graphics on the exterior of inner package container 50 through 52, as viewed by a consumer through the clear plastic from which outer package container 30 is formed. Thus, and referring specifically to the choice of materials, backing 40 may be formed of high quality material, most suitable for printing high quality images and texts as Front Indicia, in ways which create exceptional, one-of-a-kind advertising impact. Such materials include cardstock of various thickness and finish, but such materials may also include clear and opaque plastic of suitable rigidity, or even of metal, and slick plastic or metallic finishes. So long as these materials and finishes are chosen for their suitability of high-quality printing, or their transparency in the case of partial printing of a page, the Front Indicia may be of arbitrarily high quality, and resultant attractiveness.

As to the coordination of Indicia appearing on front side 41 of backing 40, the Front Indicia may be broken into sections on backing 40, and those sections coordinated with similar text and graphics on the exterior of inner package container 50, inner package container 51 and inner package container 52, as viewed by a consumer through the clear plastic from which outer package container 30 is formed, or when viewed by a consumer when outer package container 30 and backing 40 are separated from selected publication 20. More specifically, when outer package container 30 and backing 40 are first separated from selected publication 20, a consumer or subscriber is exposed to Front Indicia on front 41 of backing 40, much as she would be exposed to front 21 of selected publication 20 (and often at the same time). This allows the Indicia on front 41 of backing 40 to lead the consumer's eyes from Front Indicia on front 41 naturally to outer package container 30 and, because inner package container 50 through 52 may be viewed through the clear plastic of outer package container 30, to the similar indicia on the exterior surfaces of inner package container 50, inner package container 51, and inner package container 52. The Front Indicia on front 41 of backing 40 may be coordinated with the similar inner package container indicia on the exterior surfaces of inner package container 50 through 52, using similarity in colors and line, and using consistent trademark presentation, through similar or complimentary "look and feel," and by other means.

In this preferred embodiment of the publication package 10 of 30 the present invention, for example, backing 40 Front Indicia appearing in FIG. 4 is broken into sections "a-1" and "b-1" and "c-1," with the borders of these sections running horizontally from outer package container 30 to backing 40 edge most distant from outer package container 30 when outer package container 30 is affixed to backing 40 during manufacture. The width of sections "a-1" through "c-1" in this embodiment as these sections run across the width of backing 40 (for clarity, only section "a" is marked in FIG. 4) may be printed to correspond to the length of each of inner package container 50 and inner package container 51 and inner package container 52 contained in outer package container 30, and the Front Indicia on front 41 of backing 40 may correspond to the same or similar text and images which have been printed on the exterior of inner package container 50 and inner package container 51 and inner package container 52, along their length at sections "a-2" and "b-2" and "c-2" (for clarity, only section "a-2" marked in FIG. 4). Accordingly, when selected publication 20 is separated from outer package container 30, and pulled away from front 41 of backing 40, the eye of the consumer may be attracted to the high impact images of the Front Indicia on front 41 of backing 40, and that eye may linger over such Front Indicia, and induce that consumer to open outer package container 30, remove inner package container 50 and inner package container 51 and inner package container 52 containing product samples, and try each of the product samples contained in inner package container 50 and inner package container 51 and inner package container 52.

Figure 5:
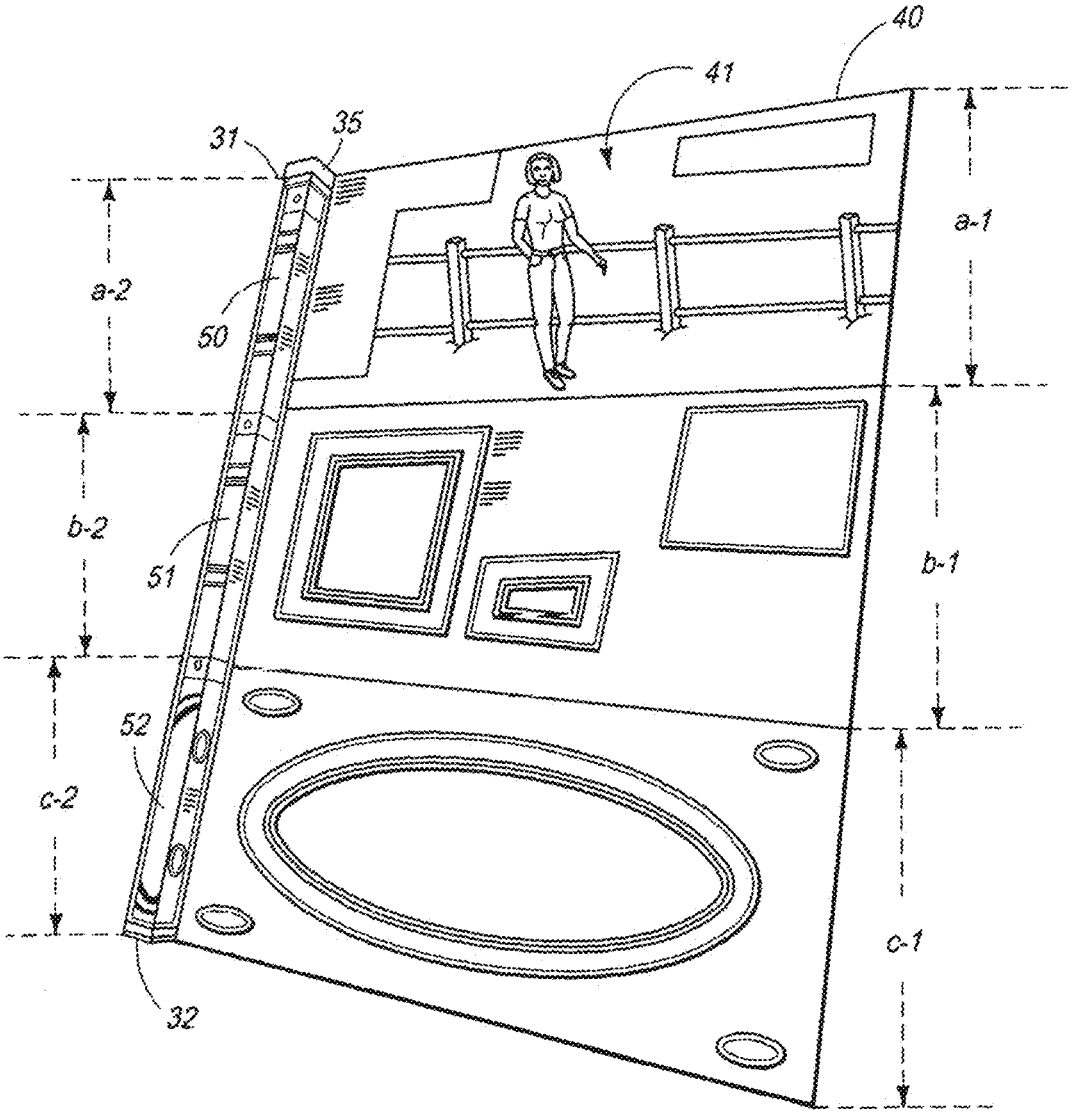
FIG. 5 is a perspective view drawing of the first preferred embodiment of the publication package appearing in FIG. 1, viewed from the front, in which the outer package container, with attached backing, has been fully separated from the selected publication.

In FIG. 5, the first embodiment of publication package 10 of the present invention shown in FIG. 1 appears again in perspective, again without shrink-wrap covering means and, in FIG. 5, also without selected publication 20. Again outer package container 30 is seen as a regular, tubular shape, with outer package container 30 top end 31 and outer package container 30 bottom end 32. In FIG. 5, we may again see the Front Indicia arrayed on front side 41 of backing 40, and again the Front Indicia is broken into sections over the area of front side 41 in such a way as to enhance the marketing impact for consumers who purchase selected publication 20. Focusing specifically on the coordination of Front Indicia appearing on front side 41 of backing 40, the Front Indicia of FIG. 5 is broken into three sections on backing 40, and those sections are coordinated with similar text and graphics on the exterior of inner package container 50 and inner package container 51 and inner package container 52. In this preferred embodiment of the publication package 10 of the present invention, backing 40 Front Indicia is broken into three sections "a-1" and "b-1" and "c-1," with the borders of these sections running horizontally from outer package container 30 to backing 40 edge most distant from outer package container 30 when outer package container 30 is affixed to backing 40 during manufacture. The width of sections "a-1" through "c-1" in this embodiment are now printed to correspond to the length of each corresponding inner package container 50 and inner package container 51 and inner package container 52, each of which are still contained within outer package container 30. Also, the Front Indicia on front 41 of backing 40 corresponds to the same or similar text and images which have been printed on the exterior of inner package container 50 through 52 along their length. Thus the width of section a-1 corresponds with the length of inner package container 50 within section a-2 of outer package container 30, the width of section b-1 corresponds with the length of inner package container 51 within section b-2 of outer package container 30, and the width of section c-1 corresponds with the length of inner package container 52 within section c-2 of outer package container 30.

Figure 6:
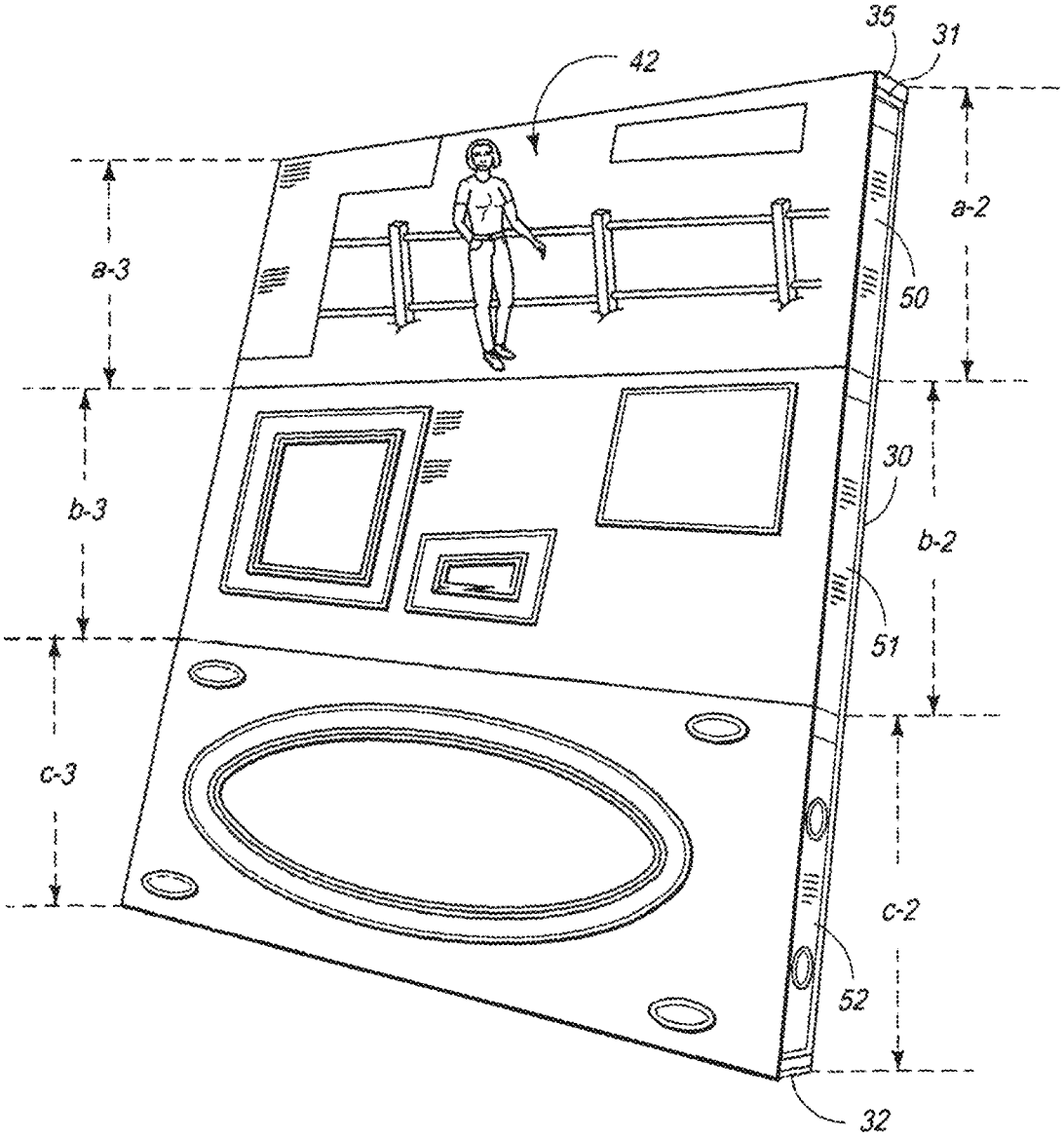
FIG. 6 is a perspective view drawing of the first preferred embodiment of the publication package appearing in FIG. 1, viewed from the back cover side, in which the outer package container, with attached backing, has been fully separated from the selected publication.

In FIG. 6, the first embodiment of publication package 10 of the present invention shown in FIG. 1 appears again in perspective, again without shrink-wrap covering means, which has been removed by the consumer. Again, publication package 10 is also shown without selected publication 20. FIG. 6 again shows outer package container 30 as a regular, tubular shape, with outer package container 30 top end 31 and outer package container 30 bottom end 32. In FIG. 6, however, we may now see the Back Indicia, which is arrayed on the back side 42 of backing 40, and again the Back Indicia is broken into sections over the area of back side 42 in such a way as to enhance the marketing impact for consumers who purchase selected publication 20. Focusing specifically on the coordination of Back Indicia appearing on back side 42 of backing 40, the Back Indicia of FIG. 6 is again broken into three sections on backing 40, and those sections are again coordinated with similar text and graphics on the exterior of each of inner package container 50, inner package container 51 and inner package container 52, as viewed by a consumer through the clear plastic from which outer package container 30 is formed. In this preferred embodiment of the publication package 10 of the present invention, backing 40 Back Indicia is again broken into three sections "a-3" and "b-3" and "c-3," with the borders of these sections running horizontally from outer package container 30 to backing 40 edge most distant from outer package container 30 when outer package container 30 is affixed to backing 40 during manufacture. The width of sections "a-3" through "c-3" in this embodiment are now again printed to correspond to the length of each of three inner package containers 50 through 52 contained in outer package container 30 in this embodiment. Also, the Back Indicia of back 42 of backing 40 correspond to the same or similar text and images which have been printed on the exterior of inner package container 50 and inner package container 51 and inner package container 52 along their length at sections "a-2" and "b-2" and "c-2."

Figure 7:
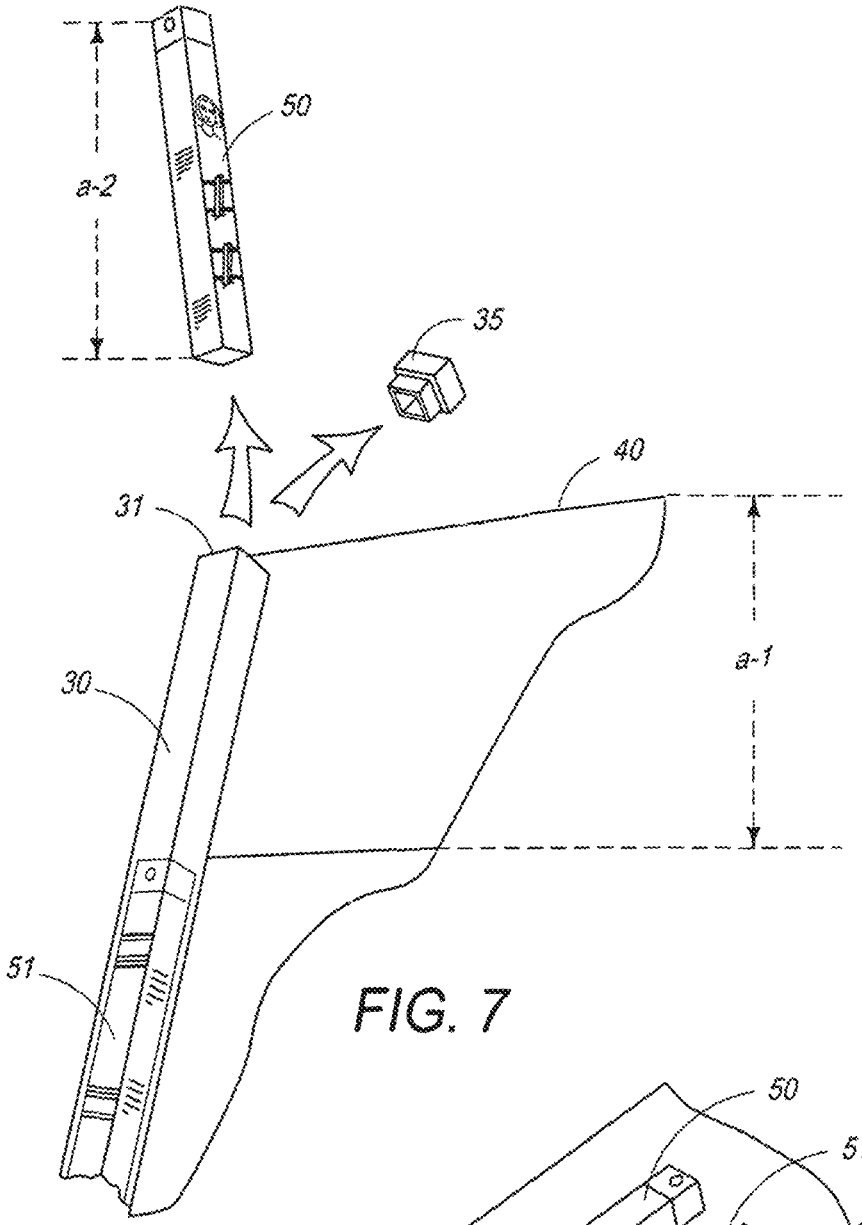
FIG. 7 is a perspective view drawing of the first preferred embodiment of the publication package appearing in FIG. 1, viewed from the front cover side, in which the closure means of the outer package container has been removed from the top end of the outer package container, and one inner package container has been removed from the same top end of the outer package container.
Figure 8:
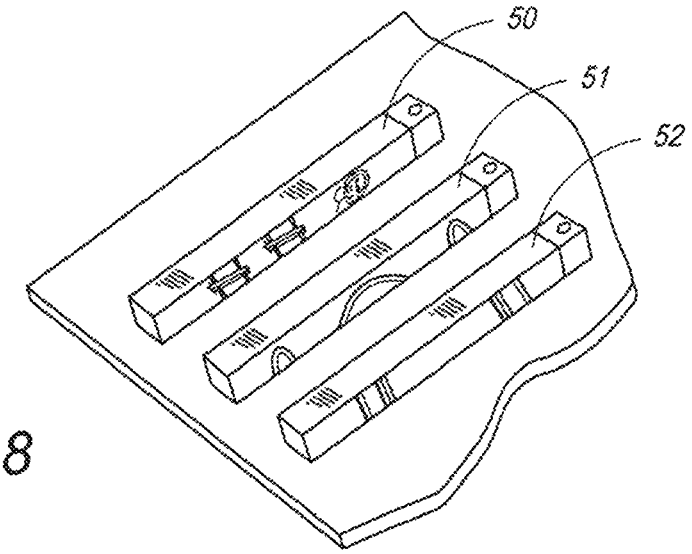
FIG. 8 is a perspective view drawing of three inner package containers of the first preferred embodiment of the publication package appearing in FIG. 1, after the closure means of the outer package container and all inner package containers have been removed from the now open end of the outer package container, and all inner package containers are in condition for use.

In FIG. 7, a portion of the first embodiment of the publication package 10 of the present invention shown in FIG. 1 appears again in perspective, again without shrink-wrap which has been removed by the consumer. Outer package container 30 is again seen as a regular, tubular shape, however only outer package container 30 top end 31 appears in FIG. 7, along with some of the length of outer package container 30, and portions of sections "a-1" and "b-1" of backing 40. For clarity, the Front Indicia shown in FIG. 5 has been removed from FIG. 7. Also inner package container 50, which may be viewed by a consumer through the clear plastic of outer package container 30 up until this point, has now been removed from outer package container 30, and is ready to be used by a consumer. In this particular example, inner package container 50 is a fragrance applicator, with spray top, by which the consumer may deploy the fragrance. Inner package container 50 can be removed from outer package container 30 by simply turning the top end 31 of outer package container 30 downward, and allowing inner package container 50 to slide out of outer package container 30. In a similar way, inner package container 51 and inner package container 52 may be removed from outer package container 30 after first removing inner package container 50. Once inner package container 50 and inner package container 51 and inner package container 52 have each been removed from outer package container 30, all inner package containers are then available for use by the consumer as seen in FIG. 8. Of course, the number of inner package containers which may be contained in outer package container 30 is limited only by the length of each inner package container, and by the length of outer package container. Accordingly, a publisher or manufacturer may place a single inner package container within outer package container 30 for delivery to a consumer, or dozens of inner package containers may be placed within outer package container 30 for delivery.

Second Preferred Embodiment

Figure 9:
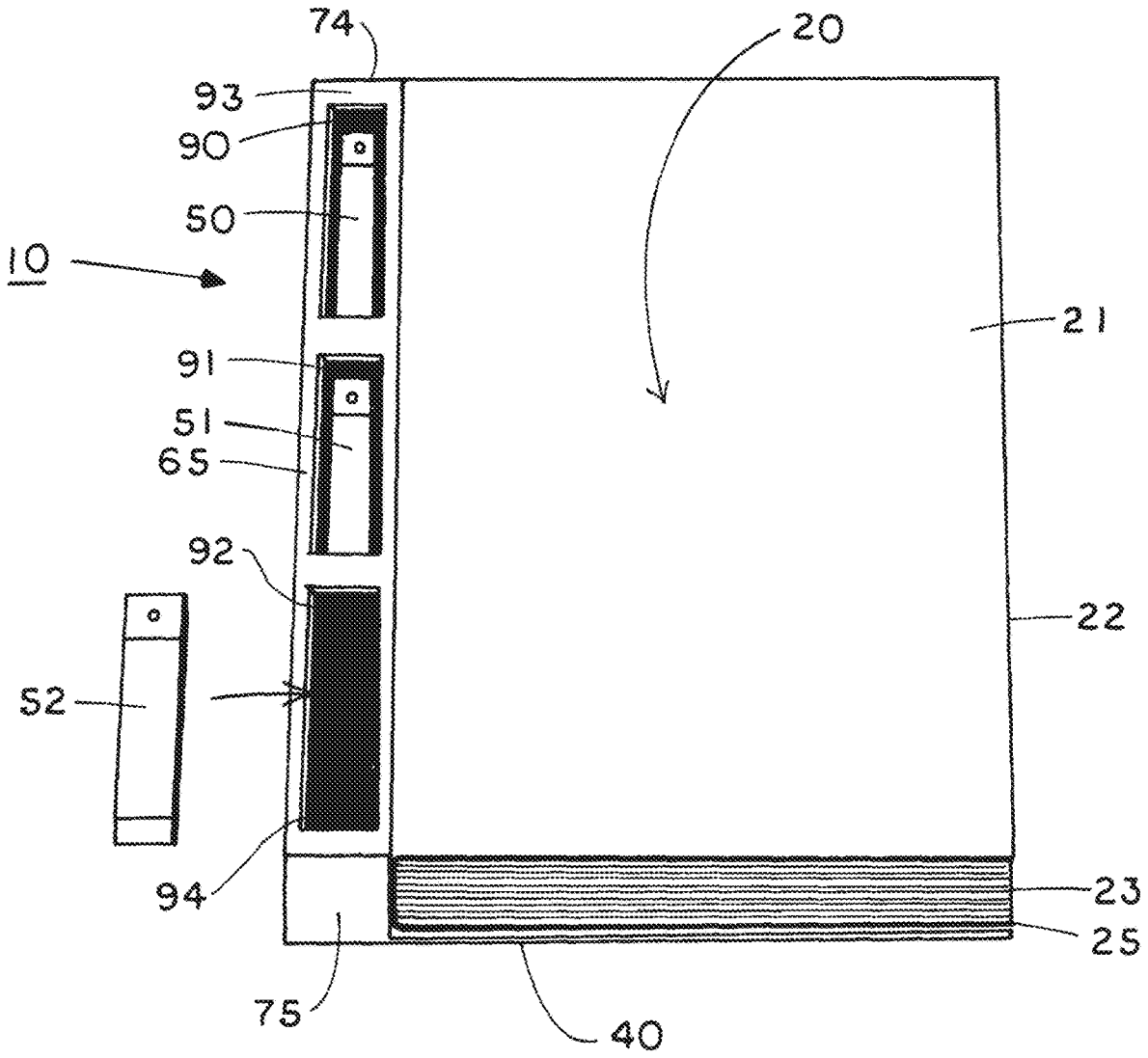
FIG. 9 is a perspective view drawing of a second preferred embodiment of the publication package of the present invention, viewed from the publication front cover and outer package container bottom end, with cut-out windows under which products are aligned.

In FIG. 9, a second preferred embodiment of the present invention shows outer package container 65 which may be formed to contain one or more cut-out windows 90-92 (or "windows") under which products, or inner package containers 50-52, or product containers are visibly aligned, so that consumers wishing to purchase selected publication 20 or one of inner package containers 50-52 contained within outer package container 65 may view its contents. Publication package 10 of the present invention is shown again in perspective, and for clarity without shrink-wrap covering means. In FIG. 9, publication package 10 has attached to it selected publication 20, viewed from selected publication 20 front cover 21 side with back cover 25 (not fully shown). Selected publication 20 page opening edge 22 may be seen, along with edges of individual pages 23 of selected publication 20. In this case, selected publication 20 is a magazine, however publication package 10 may be utilized to distribute products by accompanying a variety of publications.

Of particular importance in FIG. 9, outer package container 65 contains one or more cut-out windows 90-92 (or "windows") under which products, or inner package containers 50-52, or product containers are visibly aligned, so that consumers wishing to purchase selected publication 20 or one of inner package containers 50-52 contained within outer package container 65 may view its contents. This embodiment recognizes the desirability of providing a facility for consumers to view the actual products, or inner package containers 50-52, or product containers, before purchase through its unique alignment under windows 90-92. Instead of asking consumers to imagine the actual appearance of the products when outer package containers have no windows, the use of windows 90-92 in outer package container 65 allows consumers to view the actual products inside outer package container 65. The preferred embodiment of the present invention envisions windows 90-92 to be generally rectangular in shape. Outer package container 65 with windows 90-92 may be circular or generally rectangular (or generally square) or any other shape, so long as the consumers may view the contents within outer package container 65. Windows 90-92 can be cut out on top panel 93, side panels, or bottom panels, including the corners of outer package container 65. The preferred embodiment of the present invention envisions outer package container 65 to be made from lightweight cardstock because it is rigid yet modifiable enough so that windows 90-92 can be cut out from the material of outer package container 65. However, the material from which outer package container 65 is made should be resilient enough, and durable enough, to withstand some rough treatment when selected publication 20 is injected into the hands of standard delivery services, such as the United States Postal Service. The products, or inner package containers 50-52, or product containers, may be seen through open windows 90-92, and even inserted through open windows 90-92, and products and containers may also be taken out of outer package container 65 through its windows 90-92 when the consumer opens publication package 10. The products, or inner package containers 50-52, or product containers, may attach to inside 94 of outer package container 65 through an adhesive like glue. Open windows 90-92 may remain open without any covering, or windows 90-92 may remain covered with a transparent material such as plastic (not shown). Outer package container 65 may be left open at each end 74-75 in some embodiments, and closed by suitable closure means at each end 74-75 after filling. Outer package container 65 can be supplied with an outer package closure, or formed with a closure (not shown), which may be fitted over remaining open end 74 or 75 of outer package container 65 after the products or inner package containers 50-52 containing the products (not shown) are inserted into outer package container 65. A simple means for closure is a plug (not shown), which may be fitted within end 74 or 75 of outer package container 65, or a cap (not shown) which may be fitted over end 74 or 75 of outer package container 65. Another closure consists of at least one generally flat flap (not shown) on ends 74 or 75 (top and bottom) of outer package container 65, which flap seals the contents securely inside outer package container 65 when the top and bottom flaps are folded inwardly. However, closures may be as simple as perpendicular slits (not shown) formed in the materials of outer package container 65 near its ends 74 or 75, which allow folding of the material of the ends of outer package container 65 into its interior, to hold in place the inner package containers 50-52 to prevent shifting of the containers or products during transit.

Third Preferred Embodiment

Figure 10:
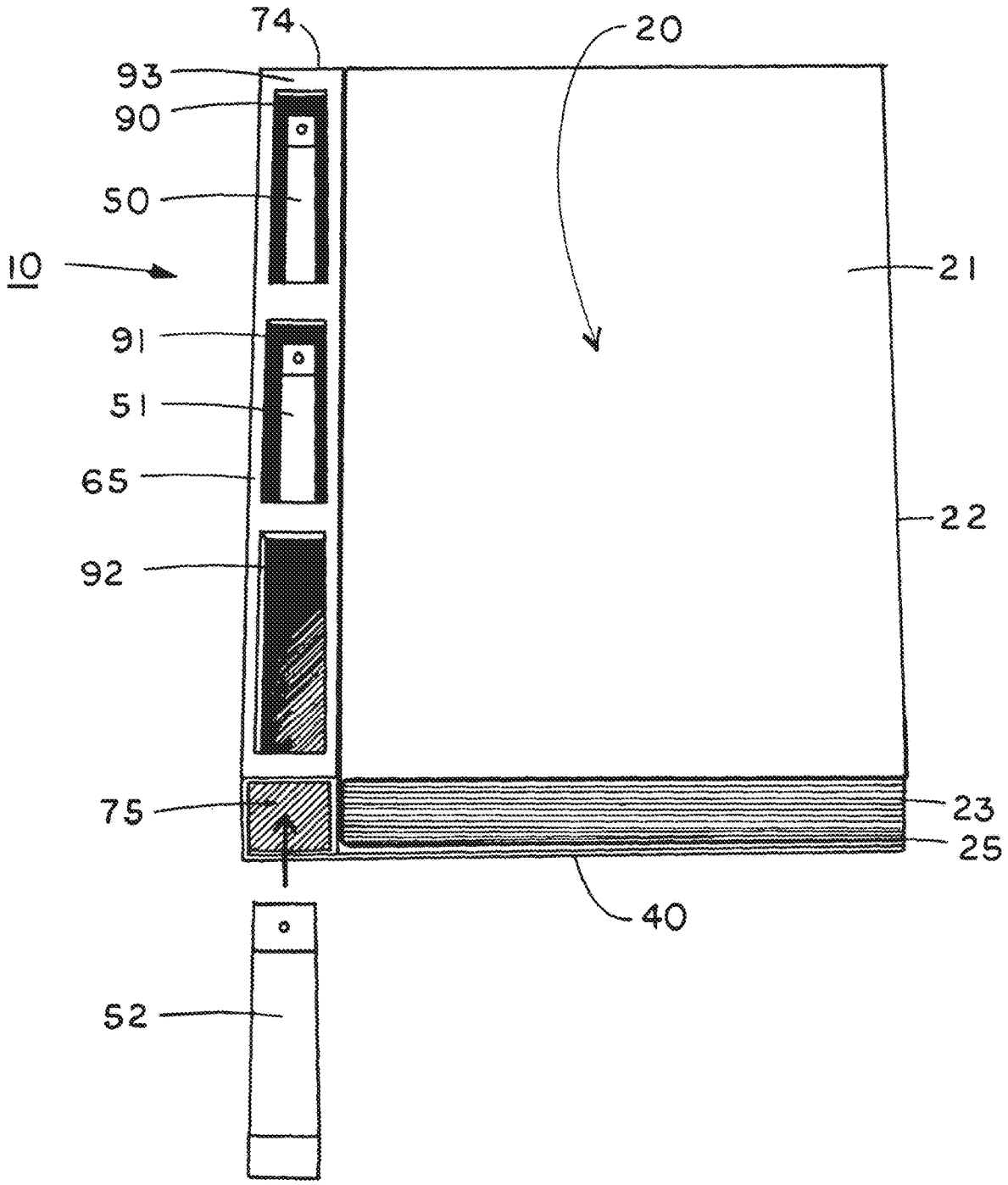
FIG. 10 is a perspective view drawing of a third preferred embodiment of the publication package of the present invention, viewed from the publication front cover and outer package container bottom end, with products inserted into open ends of outer package container with cut-out windows under which products are aligned.

In FIG. 10, a third preferred embodiment of the present invention shows outer package container 65 in which samples or inner package containers 50-52 may be inserted into open ends 74-75 of outer package container 65 to align with their respective cut-out windows 90-82. Outer package container 65 may be formed to contain one or more cut-out windows 90-92 (or "windows") under which products, or inner package containers 50-52, or product containers are visibly aligned, so that consumers wishing to purchase selected publication 20 or one of inner package containers 50-52 contained within outer package container 65 may view its contents. Publication package 10 of the present invention is shown again in perspective, and for clarity without shrink-wrap covering means. In FIG. 10, publication package 10 has attached to it selected publication 20, viewed from selected publication 20 front cover 21 side with back cover 25 (not fully shown). Selected publication 20 page opening edge 22 may be seen, along with edges of individual pages 23 of selected publication 20. In this case, selected publication 20 is a magazine, however publication package 10 may be utilized to distribute products by accompanying a variety of publications. Outer package container 65 is affixed to publication package 10 backing 40 (not fully shown), and backing 40 is positioned against the back cover 25 of selected publication 20.

Of particular importance in FIG. 10, outer package container 65 may be formed such that samples or inner package containers 50-52 may be inserted into open ends 74-75 of outer package container 65 to align with their respective cut-out windows 90-92. In this embodiment, windows 90-92 under which products, or inner package containers 50-52, or product containers are placed are visibly aligned, so that consumers wishing to purchase selected publication 20 or one of inner package containers 50-52 contained within outer package container 65 may view its contents. From the assembly standpoint, manufacturers can efficiently and quickly insert inner package containers 50-52 into open ends 74-75 of outer package container 65 instead of placing each individual sample or inner package containers 50, 51, or 52 into its respective window 90, 91, or 92. This embodiment recognizes the desirability of providing a facility for consumers to view the actual products, or inner package containers 50-52, or product containers, before purchase through its unique alignment under windows 90-92. Instead of asking consumers to imagine the actual appearance of the products when outer package containers have no windows, the use of windows 90-92 in outer package container 65 allows consumers to view the actual products inside outer package container 65. The preferred embodiment of the present invention envisions windows 90-92 to be generally rectangular in shape. Outer package container 65 with windows 90-92 may be circular or generally rectangular (or generally square) or any other shape, so long as the consumers may view the contents within outer package container 65. Windows 90-92 can be cut out on top panel 93, side panels, or bottom panels, including the corners of outer package container 65. The preferred embodiment of the present invention envisions outer package container 65 to be made from lightweight cardstock because it is rigid yet modifiable enough so that windows 90-92 can be cut out from the material of outer package container 65. However, the material from which outer package container 65 is made should be resilient enough, and durable enough, to withstand some rough treatment when selected publication 20 is injected into the hands of standard delivery services, such as the United States Postal Service. The products, or inner package containers 50-52, or product containers, may be seen through open windows 90-92, and even inserted through open windows 90-92, and products and containers may also be taken out of outer package container 65 through its windows 90-92 when the consumer opens publication package 10. The products, or inner package containers 50-52, or product containers, may attach to inside 94 of outer package container 65 through an adhesive like glue. Open windows 90-92 may remain open without any covering, or windows 90-92 may remain covered with a transparent material such as plastic (not shown). Outer package container 65 may be left open at each end 74-75 in some embodiments, and closed by suitable closure means at each end 74-75 after filling. Outer package container 65 can be supplied with an outer package closure, or formed with a closure (not shown), which may be fitted over remaining open end 74 or 75 of outer package container 65 after the products or inner package containers 50-52 containing the products (not shown) are inserted into outer package container 65. A simple means for closure is a plug (not shown), which may be fitted within end 74 or 75 of outer package container 65, or a cap (not shown) which may be fitted over end 74 or 75 of outer package container 65. Another closure consists of at least one generally flat flap (not shown) on ends 74 or 75 (top and bottom) of outer package container 65, which flap seals the contents securely inside outer package container 65 when the top and bottom flaps are folded inwardly. However, closures may be as simple as perpendicular slits (not shown) formed in the materials of outer package container 65 near its ends 74 or 75, which allow folding of the material of the ends of outer package container 65 into its interior, to hold in place the inner package containers 50-52 to prevent shifting of the containers or products during transit.

Fourth Preferred Embodiment

Figure 11:
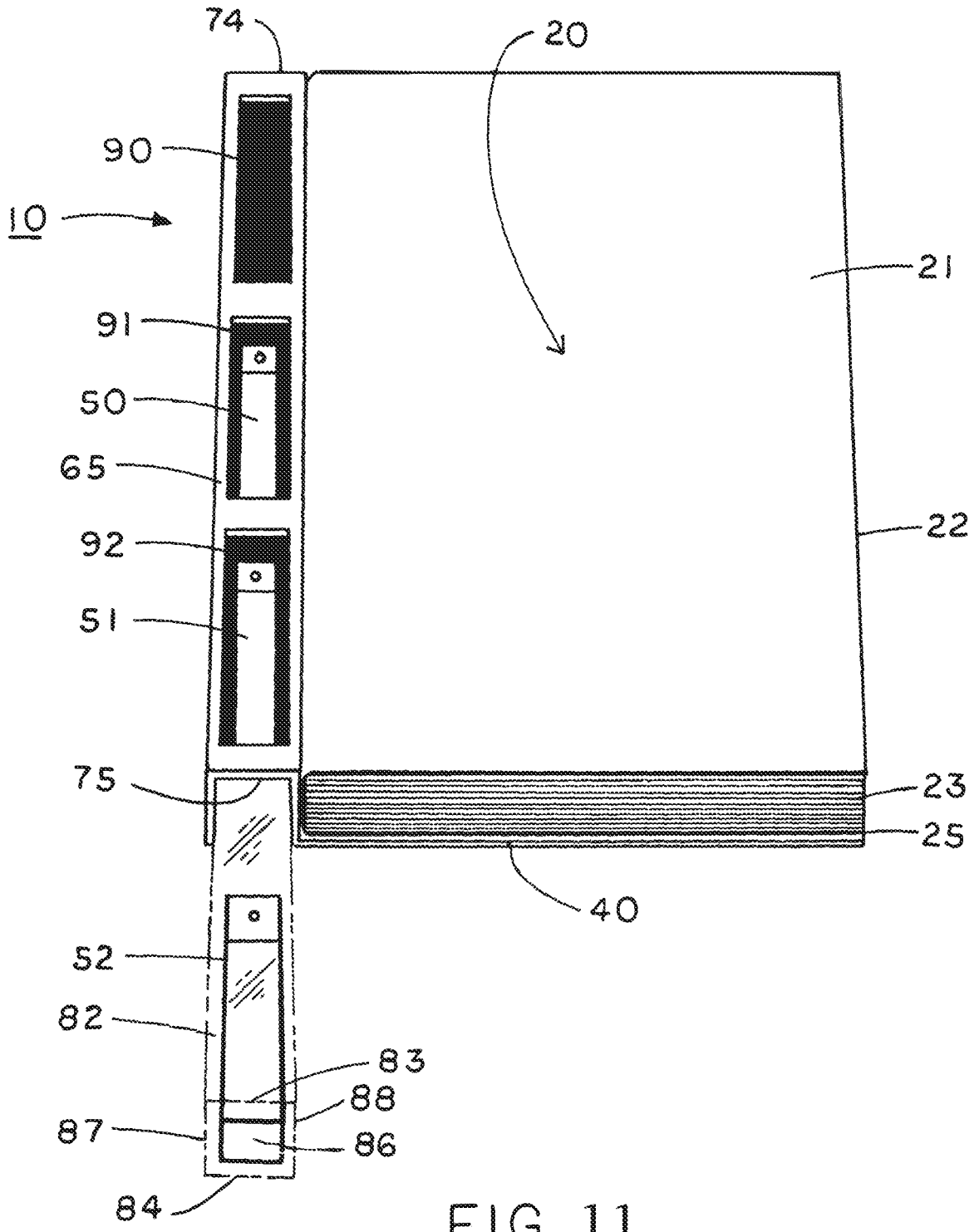
FIG. 11 is a perspective view drawing of a fourth preferred embodiment of the publication package of the present invention, viewed from the publication front cover and outer package container bottom end and drawer bottom end with six walls in open position, which contains products that align with windows when drawer is in closed position.

In FIG. 11, a fourth preferred embodiment of the present invention shows outer package container 65 which may be formed to create a hollow space wherein a transparent drawer 82 having six walls 83-88, and formed of plastic material, contains inner package containers 50-52 or samples which may be inserted in outer package container 65 to then align with one or more windows 90-92 when entire drawer 82 is inside outer package container 65. Publication package 10 of the present invention is shown again in perspective, and for clarity without shrink-wrap covering means. In FIG. 11, publication package 10 has attached to it selected publication 20, viewed from selected publication 20 front cover 21 side with back cover 25 (not fully shown). Selected publication 20 page opening edge 22 may be seen, along with edges of individual pages 23 of selected publication 20. In this case, selected publication 20 is a magazine, however publication package 10 may be utilized to distribute products by accompanying a variety of publications. Outer package container 65 is affixed to publication package 10 backing 40 (not fully shown), and backing 40 is positioned against the back cover 25 of selected publication 20.

Of particular importance in FIG. 11, outer package container 65 which may be formed to create a hollow space wherein a transparent drawer having six sides, and formed of plastic material, contains inner package containers or samples which may be inserted in the outer package container to then align with one or more windows when the entire drawer is inside the outer package container. Drawer 82 for use in outer package container 65 may be formed as a drawer with six walls 83-88, and is moveable between an open position and a closed position. Walls 83-88 of drawer 82 provide interior support and housing of the products, or inner package containers 50-52, or product containers (not shown). The preferred embodiment of the present invention envisions drawer 82 to be made from transparent plastic. Plastic walls 83-88 allows the consumer to view the contents inside outer package container 65. Viewed from the top, drawer 82 has roof wall 83, bottom wall 84, rear wall 85 (not shown), front wall 86, and two side walls 87-88. Roof wall 83, bottom wall 84, rear wall 85 (not shown), front wall 86 and two side walls 87-88 are attached along their peripheral edges thereof, leaving an opening above. Drawer 82 may include any of a variety of inserts (not shown), such as separators, to separate the samples and sample containers. These drawers and inserts can be made from suitably rigid material such as lightweight cardstock. Approximately matching the length of selected publication 20 and drawer 82 is desirable because movement of drawer 82 in relation to selected publication 20 is thereby reduced once outer package container 65 and selected publication 20 are "bundled" together within shrink wrap plastic or other means for holding outer package container 65 to selected publication 20. The length of drawer 82 is also generally uniform in width along its length, and generally rectangular in cross section, into which products, or inner package containers, or product containers may be inserted. Outer package container 65 may be left open at each end 74-75 in some embodiments, and closed by suitable closure means at each end 74-75 after filling. Outer package container 65 can be supplied with an outer package closure, or formed with a closure (not shown), which may be fitted over remaining open end 74 or 75 of outer package container 65 after the products or inner package containers 50-52 containing the products (not shown) are inserted into outer package container 65. A simple means for closure is a plug (not shown), which may be fitted within end 74 or 75 of outer package container 65, or a cap (not shown) which may be fitted over end 74 or 75 of outer package container 65. Another closure consists of at least one generally flat flap (not shown) on ends 74 or 75 (top and bottom) of outer package container 65, which flap seals the contents securely inside outer package container 65 when the top and bottom flaps are folded inwardly. However, closures may be as simple as perpendicular slits (not shown) formed in the materials of outer package container 65 near its ends 74 or 75, which allow folding of the material of the ends of outer package container 65 into its interior, to hold in place the inner package containers 50-52 to prevent shifting of the containers or products during transit.

Fifth Preferred Embodiment

Figure 12:
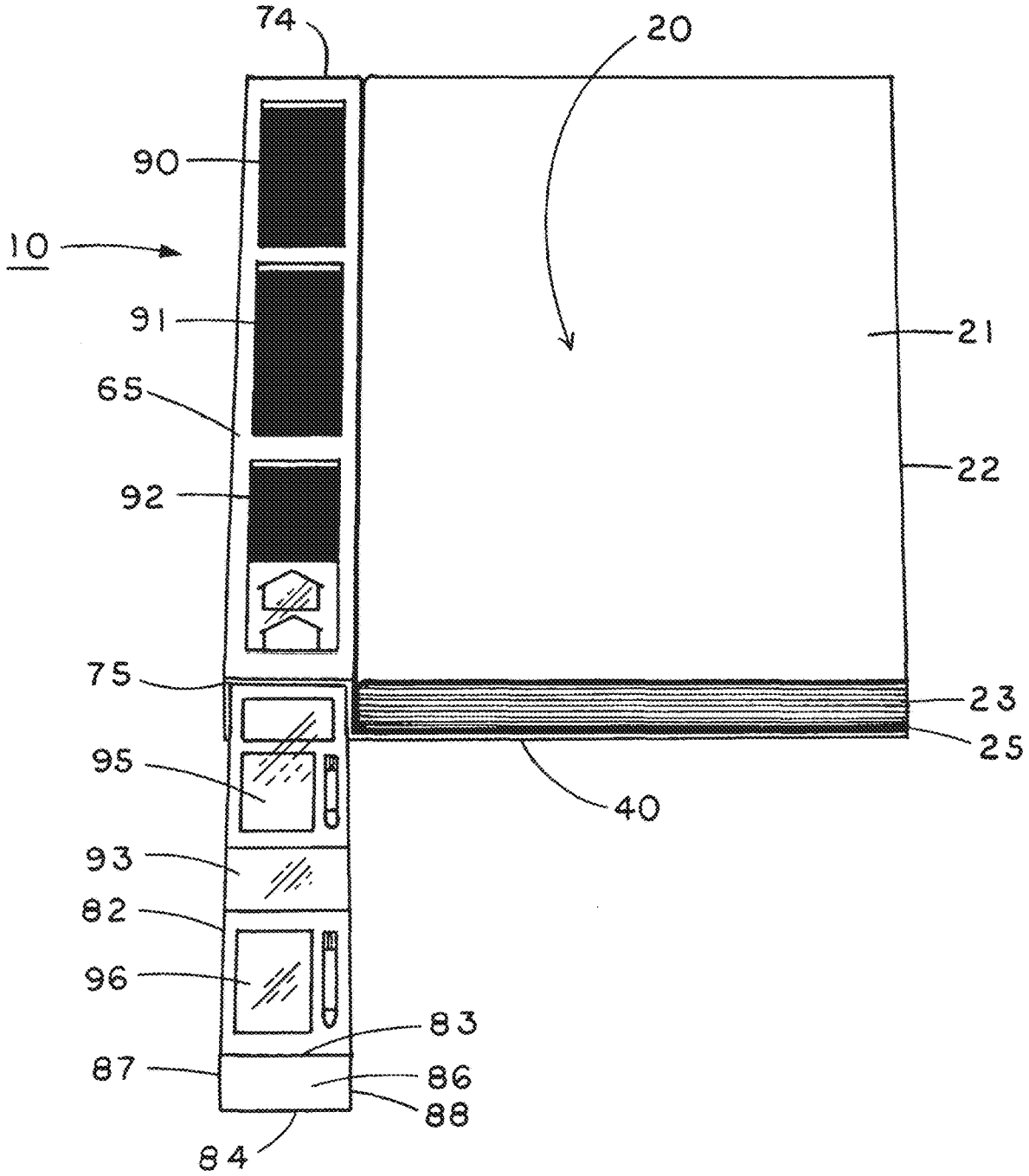
FIG. 12 is a perspective view drawing of a fifth preferred embodiment of the publication package of the present invention, viewed from the publication front cover and outer package container bottom end and drawer bottom end with six walls in open position, with products placed on a vertical strip displaying advertising text and materials.

In FIG. 12, a fifth preferred embodiment of the present invention shows outer package container 65 which creates a hollow space wherein a transparent drawer 82 having six walls 83-88, and formed from plastic material, may be inserted in the hollow space of outer package container 65 which contains vertical strip 93 (or "strip") to display advertising text and materials. Products 95-96, or inner package containers, or product containers may be placed or attached to strip 93, so that consumers can easily pull out strip 93 to retrieve products 95-96 or inner package containers or samples. Publication package 10 of the present invention is shown again in perspective, and for clarity without shrink-wrap covering means. In FIG. 23, publication package 10 has attached to it selected publication 20, viewed from selected publication 20 front cover 21 side. Selected publication 20 page opening edge 22 may be seen, along with edges of individual pages 23 of selected publication 20. In this case, selected publication 20 is a magazine, however publication package 10 may be utilized to distribute products by accompanying a variety of publications. Outer package container 65 is affixed to publication package 10 backing 40 (not fully shown), and backing 40 is positioned against the back cover 25 of selected publication 20.

Of particular importance in FIG. 12, outer package container 65 creates a hollow space wherein a transparent drawer having six walls 83-88, and formed from plastic material, may be inserted in the hollow space of outer package container 65 which contains vertical strip 93 to display advertising text and materials. Consumers can easily pull out strip 93 to retrieve products 95-96 or inner package containers or samples which may be placed or attached to strip 93. In this embodiment, strip 93 is an individual single sheet, which, in the preferred embodiment of the present invention, is made from lightweight cardstock, however all materials from which strip 93 may be made are within the scope of the present invention. Strip 93 can also attach to the interior bottom wall 84 of drawer 82 of outer package container 65 through adhesive means such glue or have no attachment at all. Products 95-96, or inner package containers, or product containers can also be attached to strip 93 through adhesive means such as glue or have no attachment at all. Strip 93 is formed about as long as the length of selected publication 20, and about as wide as the width of outer package container 65. Strip 93 can be printed with text and graphics which relate to the products 95-96 to be delivered in outer package container 65. To relate to products 95-96, the text and graphics are chosen to coordinate with text and graphics found on those products 95-96, or on the inner package container which contain those products 95-96. Drawer 82 for use in outer package container 65 may be formed as a drawer with six walls 83-88, and is moveable between an open position and a closed position. Walls 83-88 of drawer 82 provide interior support and housing of the products, or inner package containers 50-52, or product containers (not shown). The preferred embodiment of the present invention envisions drawer 82 to be made from transparent plastic. Plastic walls 83-88 allows the consumer to view the contents inside outer package container 65. Viewed from the top, drawer 82 has roof wall 83, bottom wall 84, rear wall 85 (not shown), front wall 86, and two side walls 87-88. Roof wall 83, bottom wall 84, rear wall 85 (not shown), front wall 86 and two side walls 87-88 are attached along their peripheral edges thereof, leaving an opening above. Drawer 82 may include any of a variety of inserts (not shown), such as separators, to separate the samples and sample containers. These drawers and inserts can be made from suitably rigid material such as lightweight cardstock. Approximately matching the length of selected publication 20 and drawer 82 is desirable because movement of drawer 82 in relation to selected publication 20 is thereby reduced once outer package container 65 and selected publication 20 are "bundled" together within shrink wrap plastic or other means for holding outer package container 65 to selected publication 20. The length of drawer 82 is also generally uniform in width along its length, and generally rectangular in cross section, into which products, or inner package containers, or product containers may be inserted. Outer package container 65 may be left open at each end 74-75 in some embodiments, and closed by suitable closure means at each end 74-75 after filling. Outer package container 65 can be supplied with an outer package closure, or formed with a closure (not shown), which may be fitted over remaining open end 74 or 75 of outer package container 65 after the products or inner package containers 50-52 containing the products (not shown) are inserted into outer package container 65. A simple means for closure is a plug (not shown), which may be fitted within end 74 or 75 of outer package container 65, or a cap (not shown) which may be fitted over end 74 or 75 of outer package container 65. Another closure consists of at least one generally flat flap (not shown) on ends 74 or 75 (top and bottom) of outer package container 65, which flap seals the contents securely inside outer package container 65 when the top and bottom flaps are folded inwardly. However, closures may be as simple as perpendicular slits (not shown) formed in the materials of outer package container 65 near its ends 74 or 75, which allow folding of the material of the ends of outer package container 65 into its interior, to hold in place the inner package containers 50-52 to prevent shifting of the containers or products during transit.

Sixth Preferred Embodiment

Figure 13:
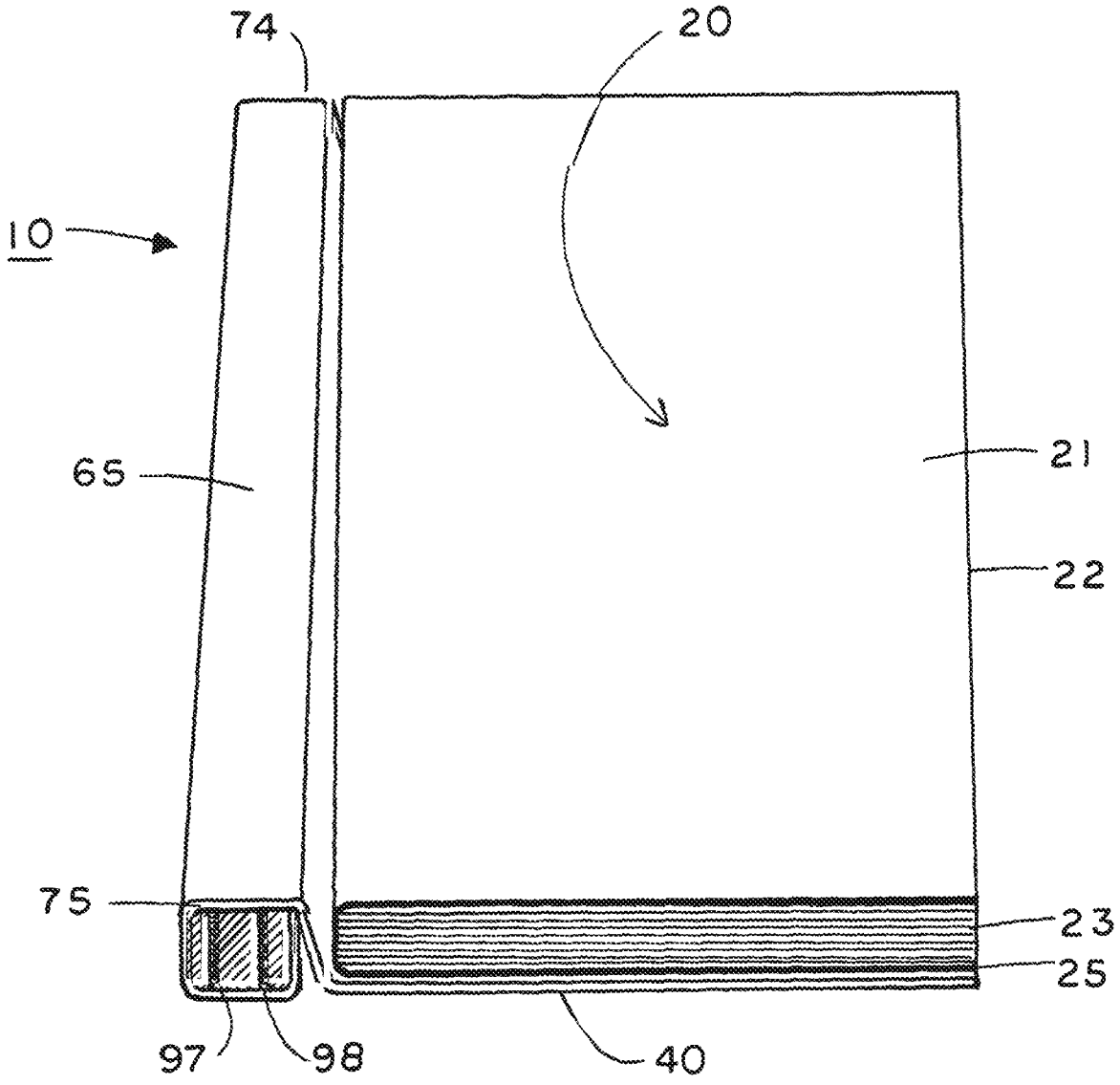
FIG. 13 is a perspective view drawing of a sixth preferred embodiment of the publication package of the present invention, viewed from the publication front cover and outer package container bottom end, with rigid insert inserted inside outer package container.

In FIG. 13, a sixth preferred embodiment present of invention shows rigid material (or "rigid inserts" 97-98) formed by cutting a blank of stiff, strong material such as corrugated cardboard which can be inserted inside 30 outer package container 65 to prevent any compromise or shifting of the samples and sample containers during transit. Publication package 10 of the present invention is shown again in perspective, and for clarity without shrink-wrap covering means. In FIG. 13, publication package 10 has attached to it selected publication 20, viewed from selected publication 20 front cover 21 side with back cover 25 (not fully shown). Selected publication 20 page opening edge 22 may be seen, along with edges of individual pages 23 of selected publication 20. In this case, selected publication 20 is a magazine, however publication package 10 may be utilized to distribute products by accompanying a variety of publications. Outer package container 65 is affixed to publication package 10 backing 40 (not fully shown), and backing 40 is positioned against the back cover 25 of selected publication 20.

Of particular importance in FIG. 13, outer package container 65 contains at least one rigid insert 97 or 98 which are formed by cutting a blank of stiff, strong material such as corrugated cardboard to be inserted inside outer package container 65. The products, or inner package containers, or product containers is supported completely in relation to the placement of the rigid inserts inside outer package container 65. Rigid inserts 97-98 may be inserted vertical and parallel to the length of outer package container 65 or horizontal and parallel to the width of outer package container 65. Rigid inserts 97-98 exhibit adequate strength for shape and size. Other lightweight materials may be specifically selected for special purposes such as rigidity and stiffness. Materials are of sufficient rigidity to properly maintain and support the products, or inner package containers, or product containers during handling and shipment. Rigid inserts 97-98 also prevent movement of the products, or inner package containers, or product containers therein. Rigid inserts 97-98 may also preferably be about as long as selected publication 20 is long or as wide as the width of outer package container 65. The preferred embodiment of the present invention envisions coplanar rigid material that is inserted perpendicular or parallel to the hollow space inside 30 outer package container 65. Approximately matching the length the selected publication 20, the rigid material is desirable to ensure all products, or inner package containers, or product containers do not shift during transit. Outer package container 65 which houses rigid inserts 97-98 may be left open at each end 74-75 in some embodiments, and closed by suitable closure means at each end 74-75 after filling. A simple means for closure is a plug (not shown), which may be fitted within end 74 or 75 of outer package container 65, or a cap (not shown) which may be fitted over end 74 or 75 of outer package container 65. Another closure consists of at least one generally flat flap (not shown) on ends 74 or 75 (top and bottom) of outer package container 65, which flap seals the contents securely inside outer package container 65 when the top and bottom flaps are folded inwardly. However, closures may be as simple as perpendicular slits (not shown) formed in the materials of outer package container 65 near its ends 74 or 75, which allow folding of the material of the ends of outer package container 65 into its interior, to hold in place the inner package containers 50-52 to prevent shifting of the containers or products during transit.

Seventh Preferred Embodiment

Figure 14:
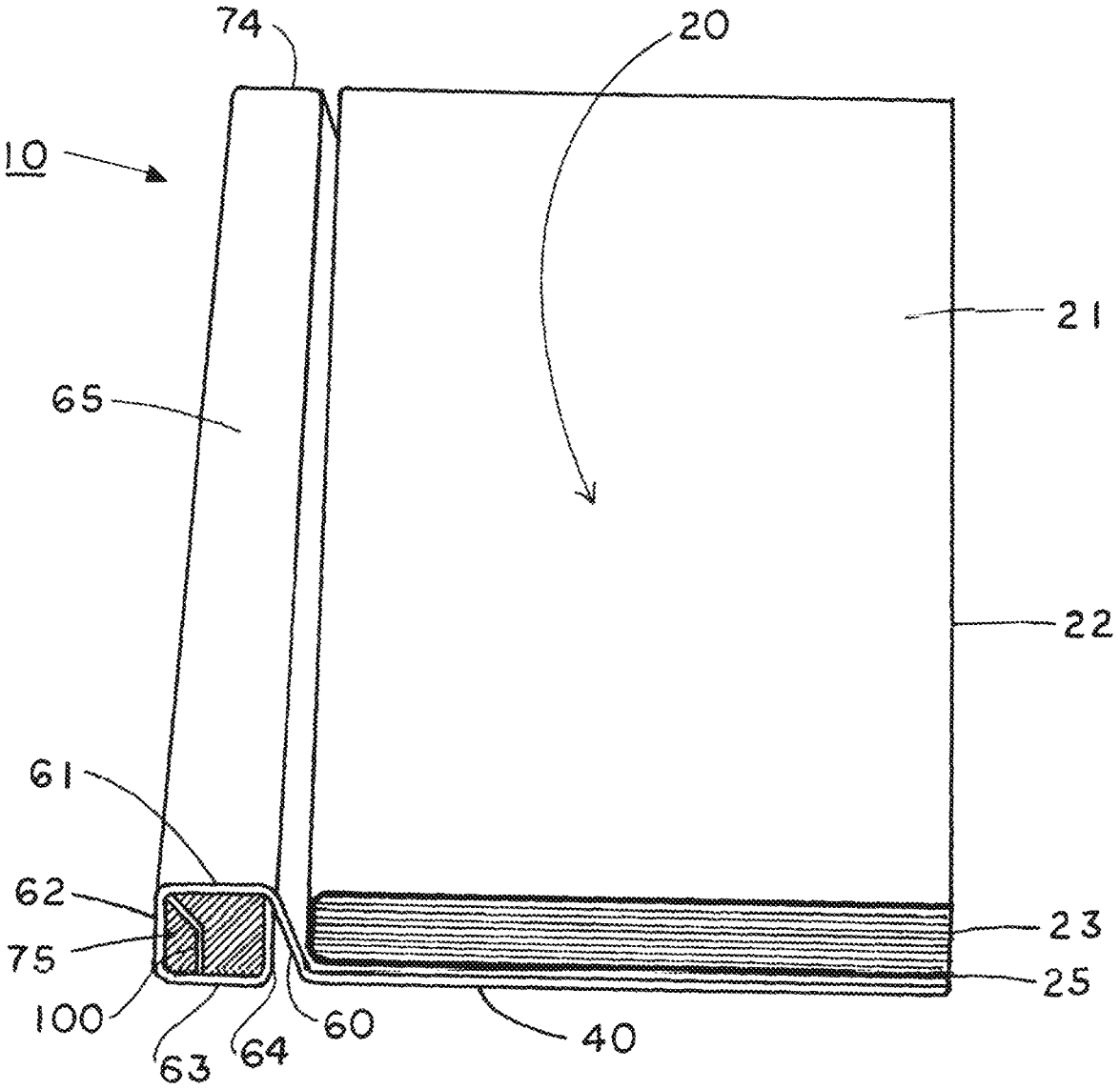
FIG. 14 is a perspective view drawing of a seventh preferred embodiment of the publication package of the present invention, viewed from the publication front cover and outer package container bottom end, with perpendicular slit formed near bottom end of outer package container.

In FIG. 14, an seventh preferred embodiment of the present invention shows perpendicular slit ("the slit" 100) which may be formed near its ends 74-75 of outer package container 65 which acts as a closure, thereby holding in place the products, inner package containers, or product containers to prevent shifting of the containers during transit. Publication package 10 of the present invention is shown again in perspective, and for clarity without shrink-wrap covering means. In FIG. 13, publication package 10 has attached to it selected publication 20, viewed from selected publication 20 front cover 21 side with back cover 25 (not fully shown). Selected publication 20 page opening edge 22 may be seen, along with edges of individual pages 23 of selected publication 20. In this case, selected publication 20 is a magazine, however publication package 10 may 30 be utilized to distribute products by accompanying a variety of publications. Outer package container 65 is affixed to publication package 10 backing 40 (not fully shown), and backing 40 is positioned against the back cover 25 of selected publication 20.

Of particular importance in FIG. 14, perpendicular slit 100 which may be formed near its ends 74-75 of outer package container 65 which acts as a closure. Closures may be as simple as perpendicular slits 100 formed in the materials of outer package container 65 near its ends 74-75, which allow folding of the materials of ends 74-75 of outer package container 65 into its interior, to hold in place the products, inner package containers, or product containers to prevent shifting of the items during transit. Though a simple means for closure is a plug (not shown), which may be fitted within end 74 or 75 of outer package container 65, or a cap (not shown) which may be fitted over end 74 or 75 of outer package container 65, closures may be as simple as perpendicular slits 100 formed near its ends 74-75 of outer package container 65. Near each end 74-75 of outer package container 65, a slit 100 is made by cutting one end corner of outer package container 65. For an outer package container 65 that is folded outwardly from backing 40, slit 100 is made by cutting end corner comprising third side wall 62 and fourth side wall 63 of outer package container 65. For outer package container 65 that is folded inwardly from backing 40, slit 100 is made by cutting the corner comprising the second and third side wall of outer package container 65 (not shown). Slit 100 can be cut at any width desirable yet sufficient to hold the products, or inner package container, or product containers. Once slit 100 is made, the corners of slit 100 are folded inwardly and perpendicularly to the bottom side wall 63 of outer package container 65. Slit 200 is folded at a perpendicular angle so as to facilitate a means for holding and locking in the ends of the inner package containers or products near its ends 74-75 of outer package container 65.

Eighth Preferred Embodiment

In FIG. 15, an eighth preferred embodiment of the present invention shows advertising card (or "double card" 101) which can function as a book cover and provide additional advertising space. Publication package 10 of the present invention is shown again in perspective, and for clarity without shrink-wrap covering means. In FIG. 15 26A, publication package 10 has attached to it selected publication 20, viewed from selected publication 20 front cover 21 side with back cover 25 (not fully shown). Selected publication 20 page opening edge 22 may be seen, along with edges of individual pages 23 of selected publication 20. In this case, selected publication 20 is a magazine, however publication package 10 may be utilized to distribute products by accompanying a variety of publications. Outer package container 65 is affixed to publication package 10 backing 40 (not fully shown), and backing 40 is positioned against the back cover 25 of selected publication 20.

Figure 15A:
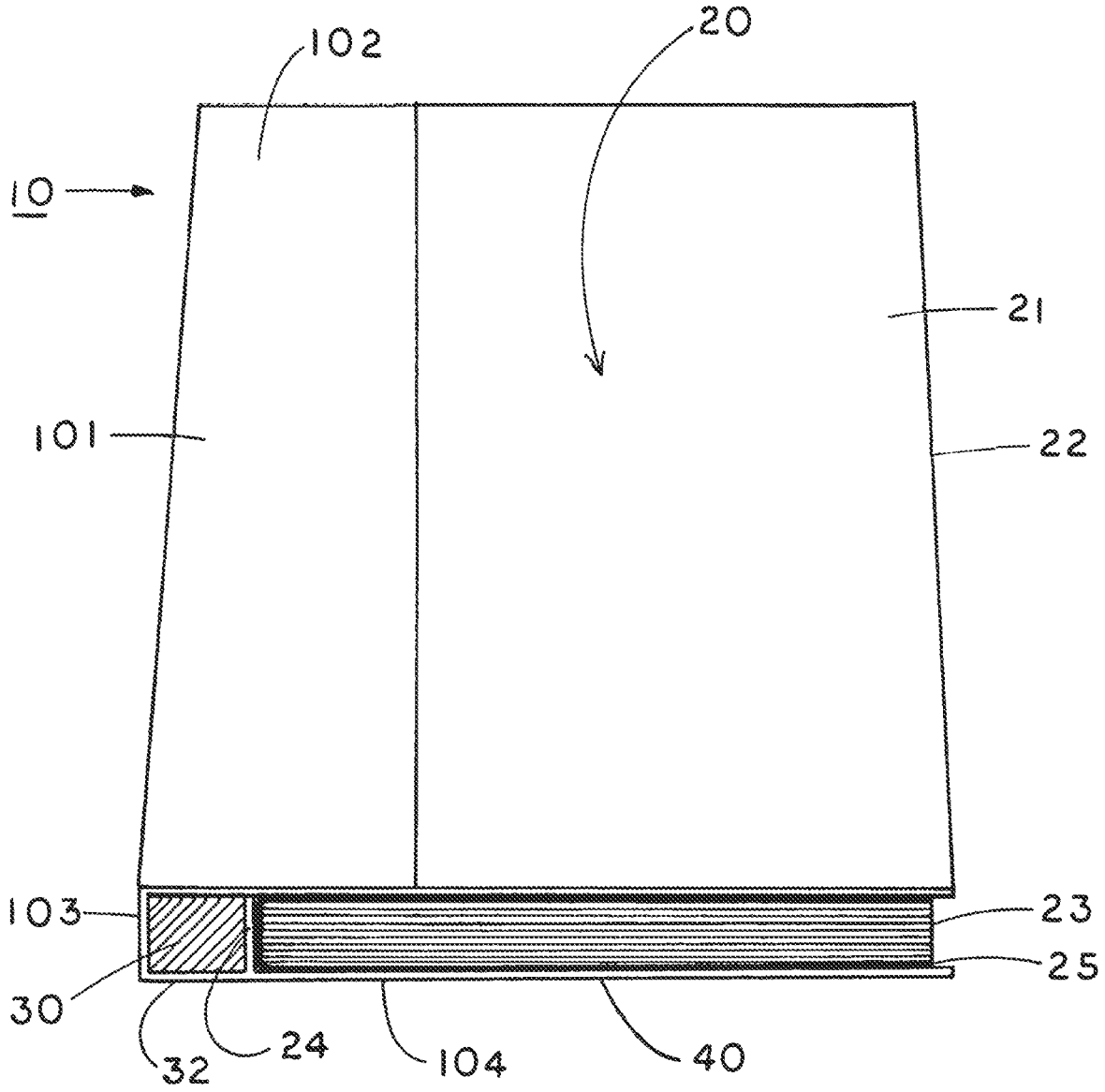
FIG. 15A is a perspective view drawing of a eighth preferred embodiment of the publication package of the present invention, viewed from the publication front cover and outer package container bottom end, with outer package container positioned against inner spine side of double card.

Of particular importance in FIG. 15A, double card 101 may function as a book cover and provide additional advertising space. Like the conventional structure of a book, double card 101 has three sides 102-104 which have front cover 102, spine side 103, and bottom cover 104 in this embodiment. Outer package container 30 is positioned against spine 103 inside front cover 102 and bottom cover 104 of double card 101. Outer package container 30 of publication package 10 may be formed in a regular, tubular shape, with outer package container 30 top end 31 (not shown) and outer package container 30 bottom end 32. Outer package container 30 and selected publication 20 is held in position so long as double card 101 remains. Double card 101 holds outer package container 30 and selected publication 20 in place while publication package 10 is in transit with or without attachment means. A means for adhering double card 101 to outer package container 30 and selected publication 20 can be by any means of an attachment, such as an adhesive, or staples. However, double card 31 need not be attached to outer package container 30 and selected publication 20 because outer package container 30 and selected publication 20 are held in position so long as double card 101 stays in position against front cover 21 and back cover 25 of selected publication 20. Double card 101 can be flipped opened in a right-to-left fashion, just as one would flip a book cover open from left to right. Alternatively, double card 101 can be placed on the opposite side of selected publication 20 and flipped open in a left-to-right fashion. This alternative placement of double card 101 is used in countries such as Japan, where reading materials are opened in a left-to-right fashion.

The preferred embodiment of the present invention envisions double card 101 to be made from lightweight cardstock, however all materials from which double card 101 may be made are within the scope of the present invention. Front cover 102, spine side 103, and back cover 104 of double card 101 can be about as long as the length of selected publication 20 or shorter, and about as wide as the width of selected publication 20, and spine edge 24 of selected publication 20. With the width about the same as spine edge 24 of selected publication 20, double card 101 will tend to stay in position against front cover 21 and back cover 25 of selected publication 20 in transit, so long as double card 101 encloses outer package container 30 and selected publication 20. Additional means to secure double card 101, selected publication 20, and outer package container 30 may include, but are not limited "poly-bagging," or "shrink wrap," or other outer cover means.

All three sides 102-104 of double card 101 in the preferred embodiment of the present invention may bear additional marketing text and graphics which are coordinated with the graphics of inner package containers 50-52 (not shown) and backing 40. Double card 101 may also be printed with text and graphics which relate to the products or inner package containers 50-52 to be delivered in outer package container 30. To relate to those products or inner package containers 50-52, double card text and graphics may be chosen to coordinate with text and graphics down on those products, or on inner package containers 50-52 which contains those products. And since double card 101 has three sides 102-104, that consistent commercial impression, which may be chosen by the product manufacturer, may occupy space on each side of double card 101 as large as the area of back cover 25 or front cover 21 of selected publication 20. On the other hand text and graphics on the back cover 104 of double card 101 may, in some embodiments of the present invention, duplicate the text and graphics on back cover 25 of selected publication 20, thereby preserving the advertising value of back cover 25, which may already have been purchased by the advertiser. The product manufacturer can maximize advertising space with publication package 10 of the present invention. All of this advertising space is viewable from the back of publication package 20 (on bottom cover 104 of double card 101) when in transit, and on front cover 102 of double card 101.

Eighth Preferred Embodiment—Open View

Figure 15B:
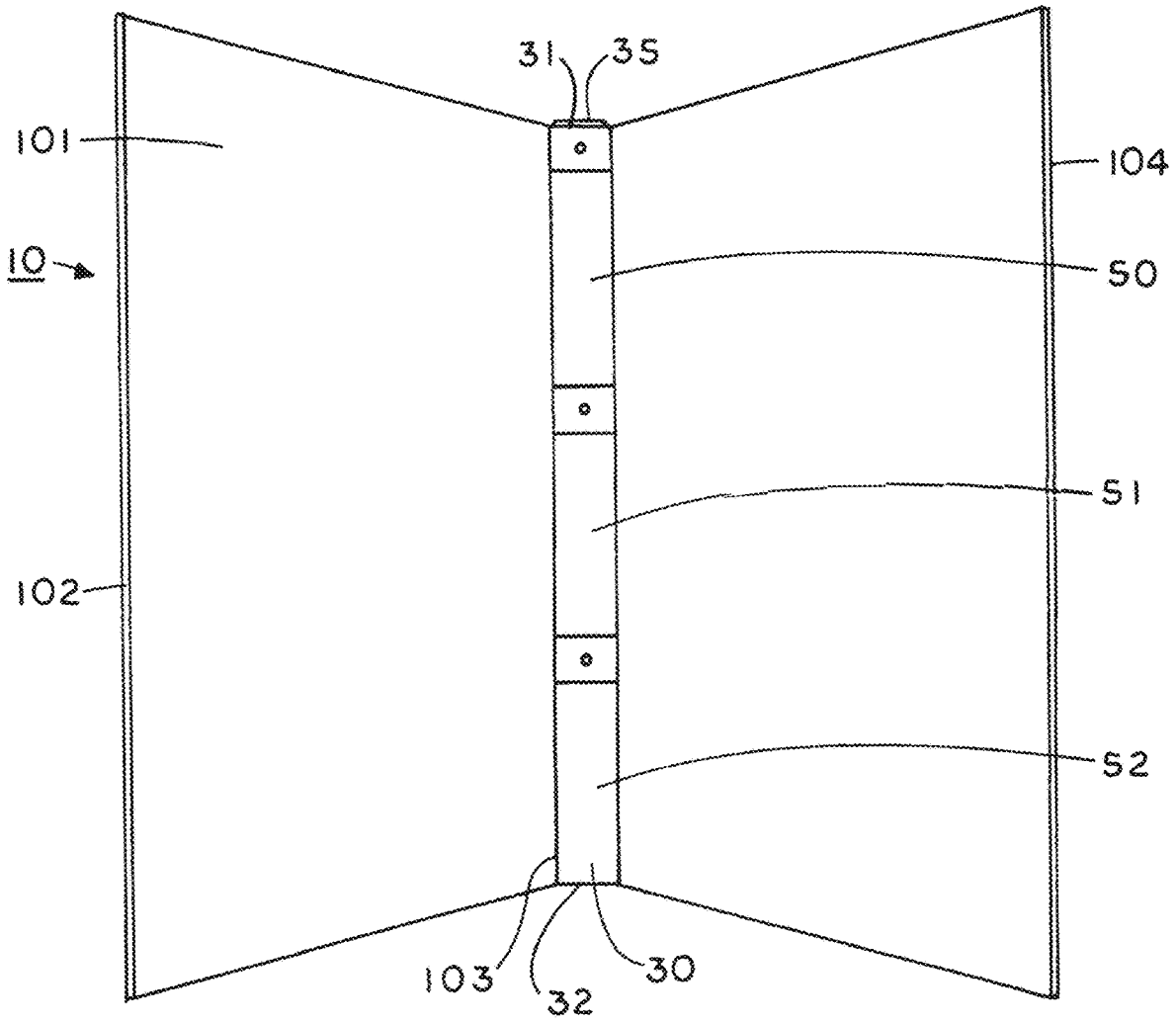
FIG. 15B is another perspective view drawing of the eighth preferred embodiment of the publication package of the present invention, viewed from the inside of an open double card, with outer package container positioned against inner spine side of double card.

In FIG. 15B, the eighth preferred embodiment of the present invention of double card 101, as described above, is shown from an open view perspective. Publication package 10 of the present invention is shown again in perspective, and for clarity without shrink-wrap covering means. In FIG. 15B, publication package 10 is shown without selected publication 20, for the purpose of showing double card 102 in greater detail.

Double card 101 has three sides 102-104 which have front cover 102, spine side 103, and bottom cover 104 in this embodiment. Outer package container 30 of publication package 10 may also be seen, formed in a regular, tubular shape, with outer package container 30 top end 31 and outer package container 30 bottom end 32. Outer package container 30 is positioned against spine 103 inside front cover 102 and bottom cover 104 of double card 101. A first generally flat side (not shown) of outer package container 30 is positioned against spine side 103 of double card 101. Outer package container 30 is formed of clear plastic in this embodiment, and three (in this embodiment) inner package containers, inner package container 50, inner package container 51, and inner package container 52, may be seen through the plastic of outer package container 30. Inner package containers 50 through 52 are positioned snugly within outer package container 30 in such a way that graphics, which may appear on the exterior sides of inner package containers 50 through 52 may be viewed through the clear plastic of outer package container 30. Outer package container closure means resides within or around outer package container 30 top end 31, to close outer package container 30 top end 31 once inner package container 50 through inner package container 52 have been placed within outer package container 30. Outer package container 30 and selected publication 20 (not shown, see FIG. 15A) is held in position so long as double card 101 remains. Double card 101 holds outer package container 30 and selected publication 20 in place while publication package 10 is in transit with or without attachment means. A means for adhering double card 101 to outer package container 30 and selected publication 20 can be by any means of an attachment, such as an adhesive, or staples. However, double card 31 need not be attached to outer package container 30 and selected publication 20 because outer package container 30 and selected publication 20 are held in position so long as double card 101 stays in position against front cover 21 and back cover 25 of selected publication 20. Double card 101 can be flipped opened in a right-to-left fashion, just as one would flip a book cover open from left to right. Alternatively, double card 101 can be placed on the opposite side of selected publication 20 and flipped open in a left-to-right fashion. This alternative placement of double card 101 is used in countries such as Japan, where reading materials are opened in a left-to-right fashion.

The preferred embodiment of the present invention envisions double card 101 to be made from lightweight cardstock, however all materials from which double card 101 may be made are within the scope of the present invention. Front cover 102, spine side 103, and back cover 104 of double card 101 can be about as long as the length of selected publication 20 (not shown) or shorter, and about as wide as the width of selected publication 20, and spine edge 24 (not shown) of selected publication 20. With the width about the same as a spine edge 24 of selected publication 20, double card 101 will tend to stay in position against front cover 21 and back cover 25 of selected publication 20 in transit, so long as double card 101 encloses outer package container 30 and selected publication 20. Additional means to secure double card 101, selected publication 20, and outer package container 30 may include, but are not limited "poly-bagging," or "shrink wrap," or other outer cover means.

All three sides 102-104 of double card 101 in the preferred embodiment of the present invention may bear additional marketing text and graphics which are coordinated with the graphics of inner package containers 50-52 and backing 40 (not shown). Double card 101 may also be printed with text and graphics which relate to the products or inner package containers 50-52 to be delivered in outer package container 30. To relate to those products or inner package containers 50-52, double card text and graphics may be chosen to coordinate with text and graphics down on those products, or on inner package containers 50-52 which contains those products. And since double card 101 has three sides 102-104, that consistent commercial impression, which may be chosen by the product manufacturer, may occupy space on each side of double card 101 as large as the area of back cover 25 or front cover 21 of selected publication 20 (not shown). On the other hand text and graphics on the back cover 104 of double card 101 may, in some embodiments of the present invention, duplicate the text and graphics on back cover 25 of selected publication 20, thereby preserving the advertising value of back cover 25, which may already have been purchased by the advertiser. The product manufacturer can maximize advertising space with publication package 10 of the present invention. All of this advertising space is viewable from the back of publication package 20 (on bottom cover 104 of double card 101) when in transit, and on front cover 102 of double card 101.

Ninth Preferred Embodiment

Figure 16A:
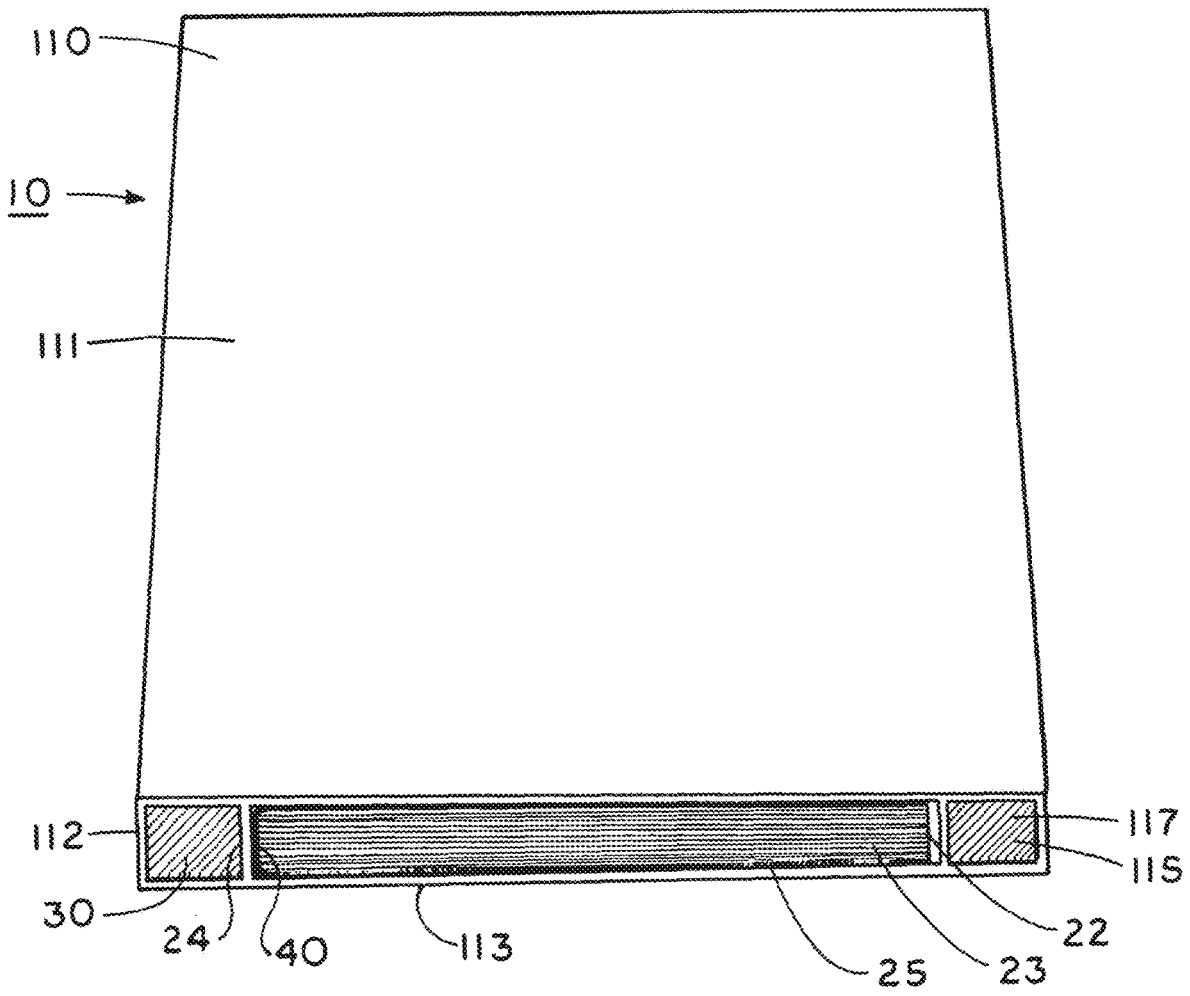
FIG. 16A is a perspective view drawing of a ninth preferred embodiment of the publication package of the present invention, viewed from the publication front cover and outer package container bottom end, with outer package containers positioned against vertical ends of bottom cover of sleeve.

In FIG. 16A, a ninth preferred embodiment of the present invention shows sleeve 110 with three sides 111-113 (or "sleeve" 110) which may also function as a book cover and provide additional advertising space. Publication package 10 of the present invention is shown again in perspective, and for clarity without shrink-wrap covering means. In FIG. , publication package 10 has attached to it selected publication 20, viewed from selected publication 20 front cover 21 side with back cover 25 (not fully shown). Selected publication 20 page opening edge 22 may be seen, along with edges of individual pages 23 of selected publication 20. In this case, selected publication 20 is a magazine, however publication package 10 may be utilized to distribute products by accompanying a variety of publications. Outer package container 65 is affixed to publication package 10 backing 40 (not fully shown), and backing 40 is positioned against the back cover 25 of selected publication 20.

Of particular importance in FIG. 16A, sleeve 110 with three sides 111-113 may function as a book cover and provide additional advertising space. Like the conventional structure of a book, sleeve 110 includes three sides 111-113 which have front cover 111, spine side 112, and bottom cover 113 in this embodiment. Sleeve 110 enwraps around publication package 10 comprising of selected publication 20 and outer package containers 30 and 115 placed vertically against each vertical end of bottom cover 113.

Sleeve 110 holds outer package containers 30 and 115 and selected publication 20 in place while publication package 10 is in transit with or without attachment means. Front cover 111 and bottom cover 113 are formed about as long as the length of selected publication 20, and about as wide as the width of selected publication 20, including spine edge 24 of selected publication 20 if any. Sleeve 110 holds outer package containers 30 and 115 and selected publication 20 in place while publication package 10 is in transit with or without attachment means. A means for adhering sleeve 110 to outer package containers 30 and 115 and selected publication 20 can be by any means of an attachment, such as an adhesive or staples. Sleeve 110 also adequately protects the face of publication package 10 during shipping and handling. Like a book cover, sleeve 110 enwraps and embodies the structural arrangement by which sleeve 110 may be folded about publication package 10. Sleeve 110 is wrapped around publication package 10, such that front cover 111, spine side 112, bottom cover 113, and opening edge 22 of selected publication 20 are covered except for the horizontal edges of selected publication 20 and horizontal and outer vertical side walls of the outer package containers 30 and 115. Sleeve 110 is an individual single sheet, which, in the preferred embodiment of the present invention, is made from lightweight cardstock, however all materials from which sleeve 110 may be made are within the scope of the present invention. After sleeve 110 is folded around publication package 10, sleeve 110 can be flipped opened in a right-to-left fashion, just as one would flip a book cover open from left to right. Alternatively, sleeve 110 may be placed on the opposite side of selected publication 20 and flipped open in a left-to-right fashion. This alternative placement of sleeve 110 is used in countries such as Japan, where reading materials are opened in a left-to-right fashion.

The preferred embodiment of the present invention envisions sleeve 110 to be made from lightweight cardstock, however all materials from which sleeve 110 may be made are within the scope of the present invention. Front cover 111, spine side 112, and bottom cover 113 of sleeve 110 can be about as long as the length of selected publication 20 or shorter, and about as wide as the width of selected publication 20, and spine edge 24 of selected publication 20. With the width about the same as spine edge 24 of selected publication 20, sleeve 110 will tend to stay in position against front cover 21 and back cover 25 of selected publication 20 in transit, so long as sleeve 110 encloses outer package containers 30 and 115 and selected publication 20. Additional means to secure sleeve 110, selected publication 20, and outer package containers 30 and 115 may include, but are not limited "poly-bagging," or "shrink wrap," or other outer cover means.

When wrapped around publication package 10, all three sides 112-112 of sleeve 110 are printed with text and graphics which relate to the products or inner package containers 50-52 (not shown) to be delivered in outer package container 30 or products, or inner package containers 118-120 (not shown) to be delivered in outer package container 115. To relate to those products or inner package containers 50-52 or 118-120, the text and graphics are chosen to coordinate with text and graphics found on those products, or on inner package containers 50-52 or 118-120 which contain those products. And since sleeve 110 has three sides 111-113, that consistent commercial impression, which may be chosen by the product manufacturer, may occupy space on each side of sleeve 110 as large as the area of back cover 25 or front cover 21 of selected publication 20. On the other hand text and graphics on back cover 113 of sleeve 110 may, in some embodiments of the present invention, duplicate the text and graphics on back cover 25 of selected publication 20, thereby preserving the advertising value of back cover 113, which may already have been purchased by the advertiser. The product manufacturer can maximize advertising space with publication package 10 of the present invention. With the width about the same as spine edge 24 of selected publication 20, publication package 10 will tend to stay in position while it is in enwrapped by sleeve 110 in transit, so long as sleeve 110 encloses publication package 10 without having its ends detached.

Ninth Preferred Embodiment—Open View

Figure 16B:
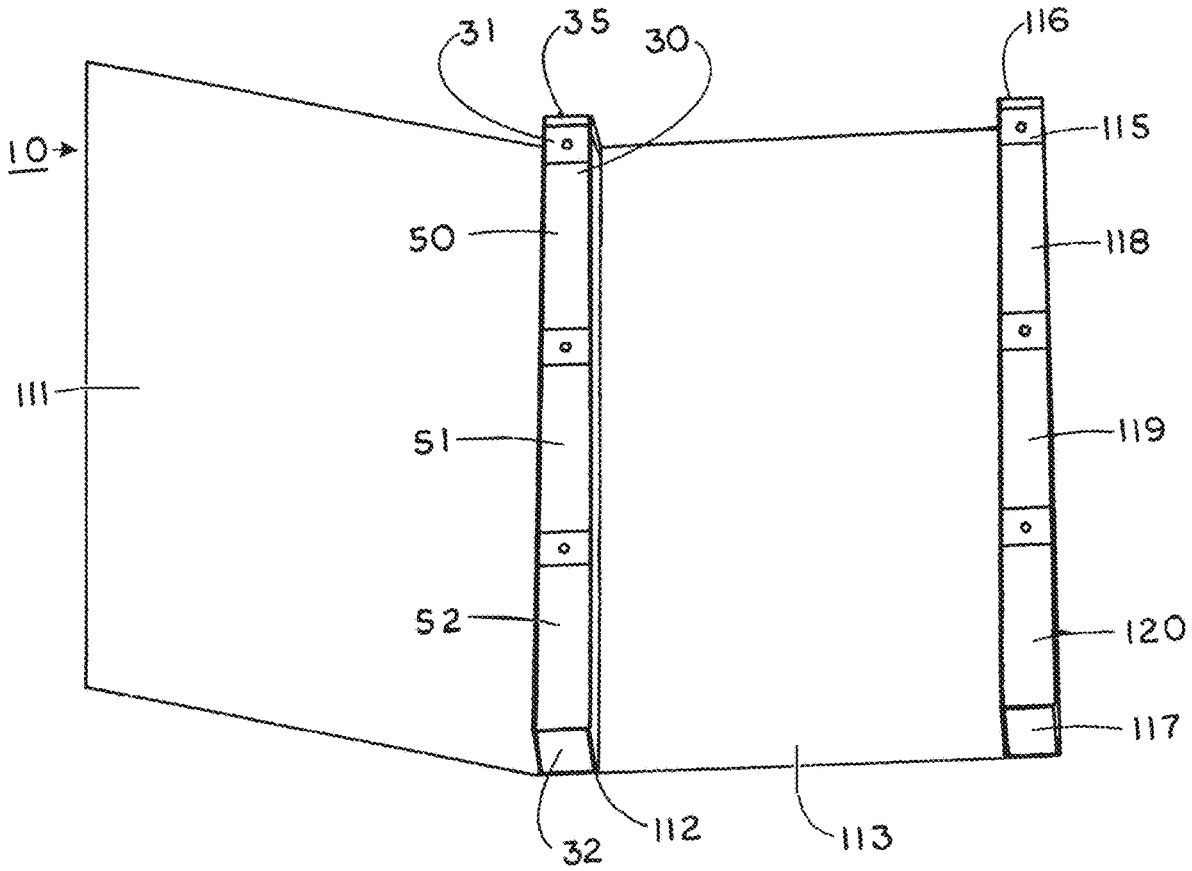
FIG. 16B is another perspective view drawing of the ninth preferred embodiment of the publication package of the present invention, viewed from the inside of an open sleeve, with outer package containers positioned against vertical ends of bottom cover of sleeve.

In FIG. 16B, the ninth preferred embodiment of the present invention of double card 101, as described above, is shown from an open view perspective. Publication package 10 of the present invention is shown again in perspective, and for clarity without shrink-wrap covering means. In FIG. 16B, publication package 10 is shown without selected publication 20, for the purpose of showing double card 102 in greater detail.

Sleeve 110 has three sides 111-113 which have front cover 111, spine side 112, and bottom cover 113. Sleeve 110 enwraps around publication package 10 comprising of selected publication 20 (not shown) and outer package containers 30 and 115 placed vertically against each vertical end of bottom cover 113. Outer package containers 30 and 115 of publication package 10 may be formed in a regular, tubular shape, with outer package container 30 top end 31 and outer package container 30 bottom end 32 as well as outer package container 115 top end 116 and outer package container 115 bottom end 117. With respect to outer package 30, a first generally flat side (not shown) of outer package container 30 is positioned against spine side 112 of sleeve 110. Outer package container 30 is formed of clear plastic in this embodiment, and three (in this embodiment) inner package containers, inner package container 50, inner package container 51, and inner package container 52, may be seen through the plastic of outer package container 30. Inner package containers 50 through 52 are positioned snugly within outer package container 30 in such a way that graphics, which may appear on the exterior sides of inner package containers 50 through 52 may be viewed through the clear plastic of outer package container 30. Outer package container closure means resides within or around outer package container 30 top end 31, to close outer package container 30 top end 31 once inner package container 50 through inner package container 52 have been placed within outer package container 30. With respect to outer package 115, a first generally flat side (not shown) of outer package container 115 is positioned against vertical end of sleeve 110. Outer package container 115 is formed of clear plastic in this embodiment, and three (in this embodiment) inner package containers, inner package container 118, inner package container 119, and inner package container 120, may be seen through the plastic of outer package container 115. Inner package containers 118 through 120 are positioned snugly within outer package container 115 in such a way that graphics, which may appear on the exterior sides of inner package containers 118 through 120 may be viewed through the clear plastic of outer package container 115. Outer package container closure means resides within or around outer package container 115 top end 116, to close outer package container 115 top end 31 or outer package container 115 bottom end 117 once inner package container 118 through inner package container 120 have been placed within outer package container 115. Sleeve 110 holds outer package containers 30 and 115 and selected publication 20 (not shown, see FIG. 21*k*) in place while publication package 10 is in transit with or without attachment means. Front cover 111 and bottom cover 113 are formed about as long as the length of selected publication 20, and about as wide as the width of selected publication 20, including spine edge 24 of selected publication 20 if any. Sleeve 110 holds outer package containers 30 and 115 and selected publication 20 in place while publication package 10 is in transit with or without attachment means. A means for adhering sleeve 110 to outer package containers 30 and 115 and selected publication 20 can be by any means of an attachment, such as an adhesive or staples. Sleeve 110 also adequately protects the face of publication package 10 during shipping and handling. Like a book cover, sleeve 110 enwraps and embodies the structural arrangement by which sleeve 110 may be folded about publication package 10. Sleeve 110 is wrapped around publication package 10, such that front cover 111, spine side 112, bottom cover 113, and opening edge 22 of selected publication 20 are covered except for the horizontal edges of selected publication 20 and horizontal and outer vertical side walls of the outer package containers 30 and 115. Sleeve 110 is an individual single sheet, which, in the preferred embodiment of the present invention, is made from lightweight cardstock, however all materials from which sleeve 110 may be made are within the scope of the present invention. After sleeve 110 is folded around publication package 10, sleeve 110 can be flipped opened in a right-to-left fashion, just as one would flip a book cover open from left to right. Alternatively, sleeve 110 may be placed on the opposite side of selected publication 20 and flipped open in a left-to-right fashion. This alternative placement of sleeve 110 is used in countries such as Japan, where reading materials are opened in a left-to-right fashion.

The preferred embodiment of the present invention envisions sleeve 110 to be made from lightweight cardstock, however all materials from which sleeve 110 may be made are within the scope of the present invention. Front cover 111, spine side 112, and bottom cover 113 of sleeve 110 can be about as long as the length of selected publication 20 or shorter, and about as wide as the width of selected publication 20 (not shown), and spine edge 24 (not shown) of selected publication 20. With the width about the same as spine edge 24 of selected publication 20, sleeve 110 will tend to stay in position against front cover 21 and back cover 25 of selected publication 20 in transit, so long as sleeve 110 encloses outer package containers 30 and 115 and selected publication 20. Additional means to secure sleeve 110, selected publication 20, and outer package containers 30 and 115 may include, but are not limited "poly-bagging," or "shrink wrap," or other outer cover means.

When wrapped around publication package 10, all three sides 112-112 of sleeve 110 are printed with text and graphics which relate to the products or inner package containers 50-52 (not shown) to be delivered in outer package container 30 or products, or inner package containers 118-120 to be delivered in outer package container 115. To relate to those products or inner package containers 50-52 or 118-120, the text and graphics are chosen to coordinate with text and graphics found on those products, or on inner package containers 50-52 or 118-120 which contain those products. And since sleeve 110 has three sides 111-113, that consistent commercial impression, which may be chosen by the product manufacturer, may occupy space on each side of sleeve 110 as large as the area of back cover 25 or front cover 21 of selected publication 20 (not shown). On the other hand text and graphics on back cover 113 of sleeve 110 may, in some embodiments of the present invention, duplicate the text and graphics on back cover 25 of selected publication 20, thereby preserving the advertising value of back cover 113, which may already have been purchased by the advertiser. The product manufacturer can maximize advertising space with publication package 10 of the present invention. With the width about the same as spine edge 24 of selected publication 20, publication package 10 will tend to stay in position while it is in enwrapped by sleeve 110 in transit, so long as sleeve 110 encloses publication package 10 without having its ends detached.

Tenth Preferred Embodiment

Figure 17:
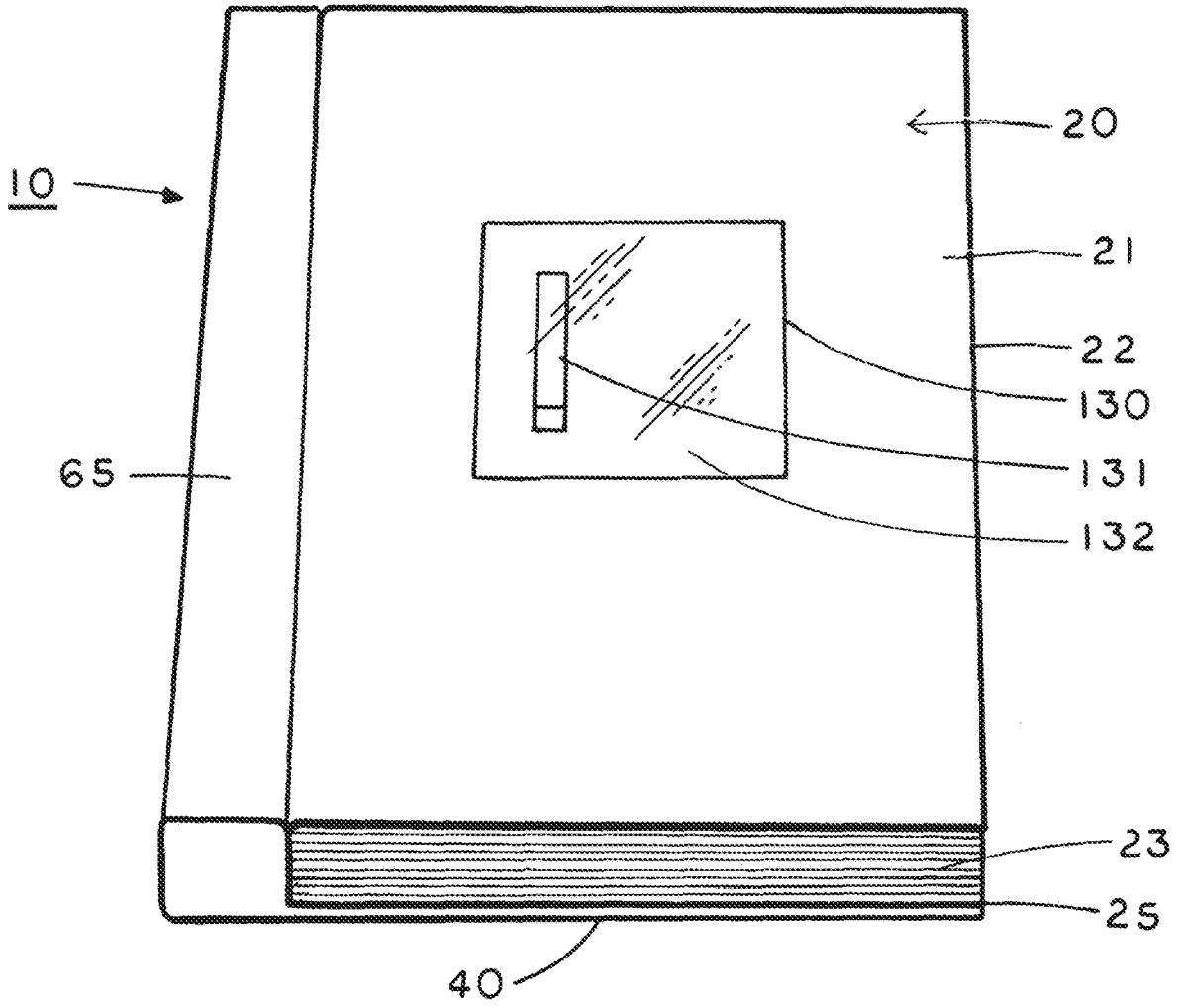
FIG. 17 is a perspective view drawing of a tenth preferred embodiment of the publication package of the present invention, viewed from the publication front cover and outer package container bottom end, with a transparent, sample bag containing a sample and advertising card.

In FIG. 17, the tenth preferred embodiment of the present invention shows sealed sample bag 130 ("or sample bag") containing sample 131 and advertising card 132 which may be placed along with publication package 10 and held in place by publication package covering means, such as a poly-bag or a shrink-wrap. Publication package 10 of the present invention is shown again in perspective, and for clarity without shrink-wrap covering means. In FIG. 17 28, publication package 10 has attached to it selected publication 20, viewed from selected publication 20 front cover 21 side. Selected publication 20 page opening edge 22 may be seen, along with edges of individual pages 23 of selected publication 20. In this case, selected publication 20 is a magazine, however publication package 10 may be utilized to distribute products by accompanying a variety of publications. Outer package container 65 is affixed to publication package 10 backing 40 (not fully shown), and backing 40 is positioned against the back cover 25 of selected publication 20.

Of particular importance in FIG. 17, sample bag 130 containing sample 131 and advertising card 132 may be placed along with publication package 10 and held in place by publication package covering means, such as a poly-bag or a shrink-wrap. In this embodiment, sample bag 130 can also be attached to selected publication 20 by means of an attachment, such as an adhesive, or staples. The covering means maintains the position of outer package container 65, backing 40, and sample bag 130. The preferred embodiment in the present invention envisions sample bag 130 to be rectangularly-shaped and made from clear plastic, so that potential consumers wishing to purchase selected publication 20 or sample 131 or sample container inside sample bag 130 may view its contents. This embodiment may have advertising card 132 and sample 131 or sample container attached to advertising card 132 by means of an attachment, such as an adhesive or staples. Additional means to secure advertising card 132 to sample 131 or sample container may include, but are not limited "poly-bagging," or "shrink wrap," or other outer cover means. Advertising card 132 may be printed with text and graphics on its front which relate to sample 131 or sample container. The back of advertising card 132 may also be printed with text and graphics so as to maximize advertising space. Advertising card 132 can be of any length, width, and shape. The preferred embodiment of the present invention envisions advertising card 132 to be made of lightweight cardstock, however, all materials from which advertising card 132 may be made are within the scope of the present invention.

Eleventh Preferred Embodiment

Figure 18:
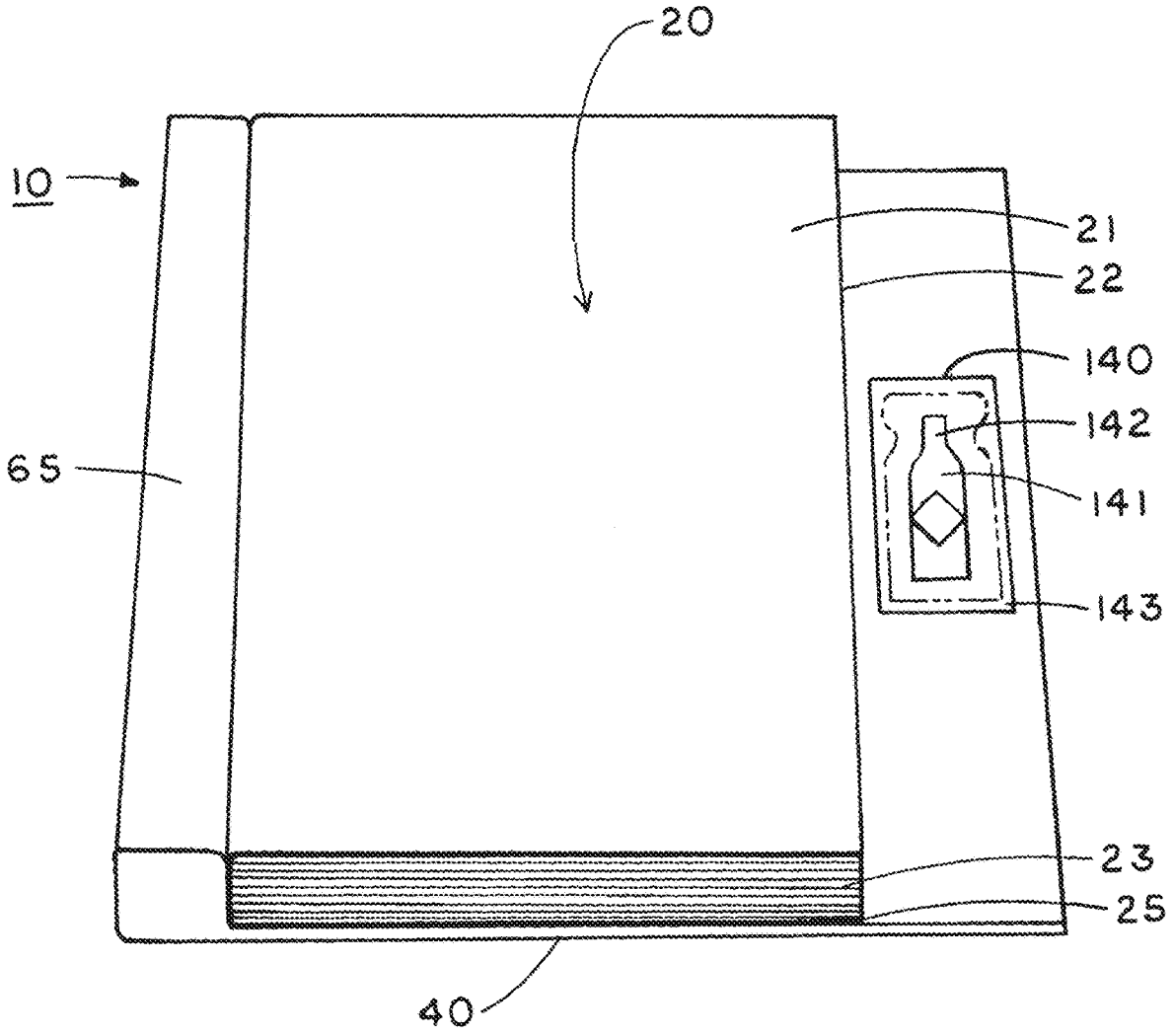
FIG. 18 is a perspective view drawing of a eleventh preferred embodiment of the publication package of the present invention, viewed from the publication front cover and outer package container bottom end, with a sample pod containing a liquid-holding sample attached to the backing of the publication package.

In FIG. 18, the eleventh preferred embodiment of the present invention shows a thermoformed, flat back packaging sample (or "sample pod" 140). Publication package 10 of the present invention is shown again in perspective, and for clarity without shrink-wrap covering means. In FIG. 18, publication package 10 has attached to it selected publication 20, viewed from selected publication 20 front cover 21 side. Selected publication 20 page opening edge 22 may be seen, along with edges of individual pages 23 of selected publication 20. In this case, selected publication 20 is a magazine, however publication package 10 may be utilized to distribute products by accompanying a variety of publications. Outer package container 65 is affixed to publication package 10 backing 40 (not fully shown), and backing 40 is positioned against the back cover 25 of selected publication 20.

Of particular importance in FIG. 18, sample pod 140 contains a liquid-holding sample 141 which may be attached to backing 40 of the publication package 10. In this embodiment, sample pod 140 can also be placed separately somewhere within publication package 10 and held in place by publication package covering means, such as a poly-bag or a shrink-wrap. The covering maintains the position of outer package container 65, backing 40, and sample pod 140. Sample pod 140 can be attached to any of backing's 40 outer vertical or horizontal edges of publication package 10 or selected publication 20 by means of an adhesive, such as glue or staples. The placement of sample pod 140 on the backing's 40 outer vertical or horizontal edge allows selected publication 20 to be held in place between outer package container 65 and sample pod 140. Sample pod 140 is made from sustainable, thermoformed material with high stiffness, good 30 compression strength and processability to withstand any leakage during heavy handling or shipment of sample pod 140. The flat back 143 packaging of sample pod 140 allows the maximal surface area to be in contact with the surface to which sample pod 140 is attached with an adhesive. Sample pod 140 can be of any length, width, and shape. The preferred embodiment in the present invention envisions sample pod 140 to be made from plastic. Sample pod 140 may also be made from transparent material, so that potential consumers wishing to purchase selected publication 20 may view sample pod's 140 contents. Sample pod 140 may be printed with text and graphics on its front which relate to liquid sample 141. Flat back 143 of sample pod 140 may also be printed with text and graphics so as to maximize advertising space. The preferred embodiment of the present invention envisions sample pod 140 to be made of plastic, however, all materials from which sample pod 140 may be made are within the scope of the present invention. The thermoformed film parts can be heat-sealed, bonded, or welded together and attached with at least one closure such as a weldspout fitment 142 or any other fitment known to those skilled in the art. A thermoforming process can include thermoforming, vacuum forming, twin sheet thermoforming, pressure forming or hot air blow forming of a film into a shaped and sculpted form.

Other embodiments will be apparent to those skilled in the art from consideration of the specification and practice of the invention disclosed herein. It is intended that the specification and examples be considered as exemplary only, with a true scope of the invention being indicated by the following claims and equivalents.

What is claimed is:

1. A publication package comprising:

an outer package container formed to create a hollow space and having at least one open end, a length and a width;

a drawer, wherein the drawer is configured to be inserted into the hollow space of the outer package container, the drawer comprising a roof wall, a bottom wall, a rear wall, a front wall, and two side walls;

a backing formed of a material rigid enough to resist folding, wherein the backing is attached to the outer package container, and is parallel to the bottom wall of the drawer and a covering means that encloses the outer package container, the drawer, and the backing.

2. The publication package of claim 1, wherein the drawer comprises at least one inner package container located within the drawer.

3. The publication package of claim 1, wherein the front wall of the drawer blocks the at least one open end of the outer package container when the drawer is inserted in the outer package container.

4. The publication package of claim 1, wherein the drawer includes an insert to prevent shifting of a position of an inner package container within the drawer.

5. The publication package of claim 1, wherein the hollow space extends through the outer package container in a first direction.

6. The publication package of claim 5, wherein the backing extends away from the outer package in a second direction, wherein the second direction is perpendicular to the first direction.

7. The publication package of claim 1, further comprising a publication having a length and a width, a front cover and a back cover, wherein the back cover is positioned against the backing, wherein a length of the publication corresponds to a length of the outer package.

8. The publication package of claim 2, further comprising a strip extending along the drawer in the first direction, wherein the strip is removable.

9. The publication package of claim 8, wherein the strip includes an opening corresponding to a placement of an inner package container in the drawer.

10. The publication package of claim 2, wherein the outer package container comprises at least one window.

11. The publication package of claim 10, wherein at least one inner package container positioned within the drawer aligns with a least one window in the outer package container, when the entire drawer is inside the outer package container.

12. The publication package of claim 1, wherein the drawer is formed of a transparent plastic material.

13. The publication package of claim 1, further comprising a closure means closing at least one open end of the outer package container.

* * * * *